US012590696B2

(12) United States Patent
Yamilev et al.

(10) Patent No.: US 12,590,696 B2
(45) Date of Patent: Mar. 31, 2026

(54) PULSE COMBUSTION APPARATUS WITH VIBRATION DAMPING

(71) Applicants: Ilgiz Amirovich Yamilev, Moscow (RU); Andrey Alekseevich Vakutin, Moscow (RU)

(72) Inventors: Ilgiz Amirovich Yamilev, Moscow (RU); Andrey Alekseevich Vakutin, Moscow (RU)

(73) Assignee: ILGIZ AMIROVICH YAMILEV, Moscow (RU)

( * ) Notice: Subject to any disclaimer, the term of this patent is extended or adjusted under 35 U.S.C. 154(b) by 816 days.

(21) Appl. No.: 17/795,528

(22) PCT Filed: Jan. 27, 2020

(86) PCT No.: PCT/RU2020/000030

§ 371 (c)(1),
(2) Date: Jul. 26, 2022

(87) PCT Pub. No.: WO2021/154107

PCT Pub. Date: Aug. 5, 2021

(65) Prior Publication Data

US 2023/0358398 A1 Nov. 9, 2023

(51) Int. Cl.

| | |
|---|---|
| ***F23C 15/00*** | (2006.01) |
| ***F23M 5/08*** | (2006.01) |
| ***F23M 20/00*** | (2014.01) |

(52) U.S. Cl.

CPC ..... *F23C 15/00* (2013.01); *F23M 5/085* (2013.01); *F23M 20/005* (2015.01); *F23D 2210/101* (2013.01); *F23D 2214/00* (2013.01)

(58) Field of Classification Search

CPC ..... F23C 15/00; F16L 51/029; G10K 11/161
See application file for complete search history.

(56) References Cited

U.S. PATENT DOCUMENTS 1,263,953 A * 4/1918 Smyth ..... F16L 51/024 285/236
2,480,626 A * 8/1949 Bodine, Jr. ..... F02K 7/06 60/39.77

(Continued)

FOREIGN PATENT DOCUMENTS

CA 2213284 A1 * 3/1998
DE 4128026 A1 * 2/1993 ..... F04D 27/003

(Continued)

OTHER PUBLICATIONS

International Search Report for PCT/RU2020/000030 dated Oct. 15, 2020, 3 pages. (with translation).

(Continued)

*Primary Examiner* — Jorge A Pereiro
(74) *Attorney, Agent, or Firm* — Nixon & Vanderhye PC

(57) ABSTRACT

The invention relates to the field of power engineering and can be used in heating systems, more particularly in water heaters or boilers, in disposal systems fueled by the combustion of associated gas, and in electrical energy generating systems. A pulse combustion apparatus comprises a combustion chamber 14, at least one resonant channel 28 connected to the combustion chamber 14, a device 15 for removing heat which is linked to the combustion chamber and to the resonant channel and which consists of at least one chamber and/or at least one tube for a heat-exchanging agent 16. A device for supplying air and combustible gas, which is connected to the combustion chamber 14, comprises at least one gaseous medium nonreturn valve 17 and at least one guard chamber 18 of said valve 17. The at least one gaseous medium nonreturn valve 17 is directly or indirectly linked to the device 15 for removing heat via a vibration isolator 19, 24.

18 Claims, 24 Drawing Sheets

(56) References Cited

U.S. PATENT DOCUMENTS 2,616,728 A * 11/1952 Pitt ..... F16L 27/1004 285/47
2,871,885 A * 2/1959 Frederick ..... F16L 51/029 285/227
2,907,382 A * 10/1959 Mcilvaine ..... F23D 17/00 431/1
3,091,224 A * 5/1963 Anders ..... F23C 15/00 431/1
3,133,754 A * 5/1964 Peters ..... F16L 27/026 285/146.1
3,469,862 A * 9/1969 Conibeer ..... F16J 3/047 174/12 R
4,030,875 A * 6/1977 Grondahl ..... F23C 3/00 60/753
4,259,928 A 4/1981 Huber
4,526,409 A * 7/1985 Schaefer ..... F16L 51/026 285/288.1
4,637,792 A * 1/1987 Davis ..... G11C 11/418 431/1
4,759,312 A 7/1988 Pletzer
4,906,174 A * 3/1990 Olsson ..... F23C 15/00 137/859
4,919,085 A * 4/1990 Ishiguro ..... F24H 1/206 431/1
4,934,923 A * 6/1990 Yokoyama ..... F23C 15/00 431/1
5,119,743 A * 6/1992 Mailliet ..... F16L 59/185 122/6.6
5,209,657 A * 5/1993 Benck ..... C21B 7/163 432/99
5,247,790 A * 9/1993 Donlan ..... F23D 17/002 60/39.55
5,588,822 A * 12/1996 Hayakawa ..... F23D 14/82 431/1
6,131,960 A * 10/2000 McHughs ..... F16L 27/1017 285/302
9,243,531 B2 * 1/2016 Tsumagari ..... F23D 11/404
10,385,780 B2 * 8/2019 Heynen ..... F02C 9/40
11,079,138 B2 * 8/2021 Suzuki ..... F24H 15/35
11,125,117 B2 * 9/2021 Jo ..... F01D 25/305

FOREIGN PATENT DOCUMENTS

EP 2317221 A1 * 5/2011 ..... F23C 9/00
KR 20150075555 A * 7/2015
KR 101681453 B1 * 12/2016
RU 2 175 422 10/2001
RU 2293253 C1 * 2/2007
RU 2 549 279 4/2015
WO WO-2010034940 A1 * 4/2010 ..... F16K 15/08

OTHER PUBLICATIONS

Written Opinion of the ISA for PCT/RU2020/000030 dated Oct. 15, 2020, 3 pages.
Fulton Pulse HW (PHW) Fully Condensing Hydronic Boiler User Manual, p. 11: How to install elastomer cube isolation mounts guideline, Fulton company indicates a need to install a vibration damper when mounting a pulse combustion apparatus (http://www.manualsdir.com/manuals/345492/fulton-pulse-hw-phw-fully-condensing-hydronic-boiler.html?page=1 1,), 2013.

* cited by examiner

A – A

A – A

B-B

B-B

PULSE COMBUSTION APPARATUS WITH VIBRATION DAMPING

This application is the U.S. national phase of International Application No. PCT/RU2020/000030 filed Jan. 27, 2020 which designated the U.S., the entire contents of which is hereby incorporated by reference.

FIELD OF THE INVENTION

The invention relates to the field of power engineering and can be used in heating systems, more particularly in water heaters or boilers, in disposal systems fueled by the combustion of associated gas, and in electrical energy generating systems.

PRIOR ART

Pulse combustion apparatuses are known for high coefficient of efficiency and small size and weight per unit of power. However, during operation they generate a high level of vibration at the place of installation, in a heat transfer fluid hydraulic system, in smoke extraction system and in air supply system. Vibrations decrease the equipment life and lead to high level of noise and other unfavorable consequences. Vibrations may spread to rooms located far from pulse combustion apparatus. Vibrations lead to a significant deterioration of human environment.

Measures are taken to decrease vibrations generated by pulse combustion apparatuses. U.S. Pat. No. 4,919,085 employs sand in the air valve housing to reduce a pulse combustion apparatus vibration. In Fulton Pulse HW (PHW) Fully Condensing Hydronic Boiler User Manual, Page 11: How to install elastomer cube isolation mounts guideline, FULTON company indicates a need to install a vibration damper when mounting a pulse combustion apparatus (http://www.manualsdir.com/manuals/345492/fulton-pulse-hw-phw-fully-condensing-hydronic-boiler.html?page=11,).

The closest to the proposed invention is the pulse combustion apparatus according to U.S. Pat. No. 4,259,928, where the air cylinder containing an air nonreturn valve in the air supply channel is connected with the pulse combustion apparatus cover by a vibration damper; besides, the exhaust cylinder in a vent gases exhaust chamber is connected to an exhaust pipe by a vibration damper and the whole boiler is mounted on vibration dampers.

Although not all manufacturers indicate a need to connect pulse combustion apparatuses to a heat transfer fluid hydraulic system using vibration dampers, this need is obvious to specialists in the art.

The measures employed do not produce a desired result and may be improved significantly.

SUMMARY OF THE INVENTION

The technical issue addressed by the current invention is a decrease of the level of vibration in pulse combustion apparatuses by a decrease of the level of vibrations generated by a gaseous medium nonreturn valve.

The technical issue is solved by a pulse combustion apparatus comprising a combustion chamber, at least one resonant channel connected to the combustion chamber, a device for removing heat which is linked to the combustion chamber and to the resonant channel and which consists of at least one chamber and/or at least one tube for a heat-exchanging agent, a device for supplying air and combustible gas, which is connected to the combustion chamber, comprising at least one chamber and/or at least one tube for a heat-exchanging agent, a device for supplying air and combustible gas, which is connected to the combustion chamber, comprising at least one gaseous medium nonreturn valve and at least one guard chamber of at least one nonreturn valve, while at least one gaseous medium nonreturn valve is directly or indirectly linked to a the device for removing heat via a vibration isolator.

A form of embodiment is possible, where the resonant channel comprises at least one resonant tube.

Besides, a variant where the combustion chamber is located in a tube, while the resonant channel comprises a gap between the tube and the combustion chamber is possible.

It is preferrable that the walls of at least one guard chamber are lined with a material with sound absorbing properties.

A form of embodiment is possible where the apparatus comprises at least two gaseous media nonreturn valves, at least one of said valves is an air nonreturn valve and at least one of said valves is a combustion gas non-return valve, and at least two guard chambers, respectively, for at least one air nonreturn valve and at least one combustion gas nonreturn valve.

A form of embodiment is also possible where at least one gaseous media nonreturn valve is a combustion mixture nonreturn valve.

A preferrable form of embodiment includes at least one gaseous media nonreturn valve, which is a mechanical nonreturn valve.

A form of embodiment of an apparatus is possible when at least one gaseous media nonreturn valve is directly linked to a device for removing heat via a vibration isolator.

In another form of embodiment, at least one gaseous media nonreturn valve is indirectly linked to a device for removing heat via a combustion chamber using a vibration isolator, while at least one gaseous media nonreturn valve outlet is linked to a combustion chamber by two connection pipes interconnected with a vibration isolator.

Besides, at least one gaseous media nonreturn valve is indirectly linked to a device for removing heat via its guard chamber using a vibration isolator, while at least one gaseous media nonreturn valve outlet is linked to a guard chamber by two connection pipes interconnected with a vibration isolator.

A form of embodiment is also possible where at least one air nonreturn valve is indirectly linked to a device for removing heat via a guard chamber using a vibration isolator, at least one combustion gas nonreturn valve, while at least one air nonreturn valve is linked with the guard chamber, at least one combustion gas nonreturn valve linked by two connection pipes interconnected using a vibration isolator, one of which is connected to the corresponding air nonreturn valve outlet.

Besides, at least one air nonreturn valve is indirectly linked to a device for removing heat via interconnected guard chamber of an air nonreturn valve and guard chamber of combustion gas nonreturn valve, while at least one air nonreturn valve inlet is connected with a guard chamber of an air non-return valve by two connection pipes interconnected with a vibration isolator, one of which is connected to a corresponding air nonreturn valve inlet. Besides, at least one air nonreturn valve is indirectly linked to a device for removing heat via a guard chamber of an air nonreturn valve and guard chamber of combustion gas nonreturn valve, while an air nonreturn valve inlet is connected with a guard chamber of an air non-return valve, which is connected to a combustion gas nonreturn valve guard chamber by two connection pipes interconnected with a vibration isolator.

Besides, at least one air nonreturn valve is indirectly linked with a heat-exchange agent chamber via a combustion chamber using the first vibration isolator while at least one air nonreturn valve is linked directly or via a guard chamber of a combustion gas nonreturn valve, with a combustion chamber, connected to a heat-exchange agent chamber by the first vibration isolator.

Here, at least one air nonreturn valve is additionally linked with a heat-exchange agent chamber using at least one second vibration isolator indirectly via at least one resonant tube, while the end of at least one resonant tube is connected to a heat-exchange agent chamber using at least one corresponding second vibration isolator.

Besides, at least one air nonreturn valve is indirectly linked to a device for removing heat using two consecutively located vibration isolators, while at least one air nonreturn valve inlet is connected via the first vibration isolator with the inlet of a guard chamber of at least one air nonreturn valve, while an outlet of a guard chamber of an air nonreturn valve is linked via the second vibration isolator with a guard chamber of at least one combustion gas nonreturn valve connected to a device for removing heat.

Vibration isolator may comprise a cylinder-shaped element with at least one transverse corrugation.

Besides, a vibration isolator may comprise a cylinder-shaped element made of elastic material.

Besides, a vibration isolator may comprise a circular membrane, flat or having one or more circular corrugation.

A form of embodiment is possible where at least one shock wave damper rigidly connected to a corresponding nonreturn valve is installed along the gaseous media flow on at least one gaseous media nonreturn valve inlet and/or outlet.

Here, a gaseous media nonreturn valve and at least one damper have the same housing.

Besides, at least one gaseous media nonreturn valve with a rigidly connected shock wave damper are fixed in a required spatial position using elastic elements.

Besides, in an apparatus with any variant of vibration isolators location, at least one gaseous media nonreturn valve is connected to a device for removing heat indirectly via a combustion chamber using a vibration isolator, while at least one gaseous media nonreturn valve is linked to a combustion chamber using a pipe with coaxial connecting pipes located between a tube and a vibration isolator and interconnected forming a maze with an inlet hole made in the said pipe.

Significant vibration and noise during operation are actual issues of pulse combustion apparatuses. Mufflers used in vent gases exhaust chambers and air supply chambers as well as vibration isolation of pulse combustion apparatuses from the place of installation and from hydraulic system have little effect. Meanwhile, despite the use of mufflers and vibration isolators, a high level of noise generated by vibration of structural components of a pulse combustion apparatus remains.

It is evident to pulse combustion specialists that the main source of vibration and acoustic noise in pulse combustion apparatuses is a combustion chamber, where, according to a description of U.S. Pat. No. 4,919,085, an explosive combustion is thought to be occurring.

The studies conducted revealed, that a combustion chamber of pulse combustion apparatuses generates insignificant vibrations during operation, several fold lower as compared to a permissible level, and thus the acoustic noise generated by these vibrations is also significantly lower than the permissible level. The only source of significant vibration and acoustic noise generated by such vibrations in pulse combustion apparatuses are gaseous media nonreturn valves.

Gaseous media nonreturn valves during operation of pulse combustion apparatuses generate a steep front of gas flow velocity and pressure change with characteristics similar to that of a shock wave. This phenomenon is referred hereinafter as the shock wave. The shock wave is a source of vibration and noise of high intensity. Thus, pulse combustion apparatuses operation generates additional vibration and noise of high intensity due to the shock wave.

The shock wave in pulse combustion apparatuses is generated by nonreturn valves. The shock wave has the highest impact on the walls of a nonreturn valve where it is generated. This impact is similar to a shock with a hard object and generates high-intensity vibration of a valve walls.

Pulse combustion apparatuses may include aerodynamic nonreturn valves and mechanical nonreturn valves. The shock wave formation in a dynamic nonreturn valve occurs during the return flow of vent gases due to deceleration and collision of opposite gas flows that are increased by the fact that the velocity of back particles is higher than the velocity of front particles, while the steepness of flow rate changes increases, generating a shock valve.

The character of the shock wave formation in a mechanical nonreturn valve is similar to the shock wave formation in a dynamic nonreturn valve. The shock wave in a mechanical nonreturn valve is generated during an instant deceleration of a return gas flow.

It is known in various technical fields that nonreturn valves may generate vibrations and acoustic noise. These vibrations are generated by a shock of a locking moving element against a fixed housing of a nonreturn valve, generating vibration and noise.

It is evident for the specialists that a moving element of a valve may generate vibrations due to a shock of a moving element against a fixed nonreturn valve housing. However, vibrations in pulse combustion apparatuses are generated by a sudden change of gas flow rate.

For pulse combustions apparatuses specialists, the only evident source of vibration and acoustic noise is an explosive combustion in a combustion chamber.

According to the current invention, a decrease of vibration and acoustic noise generated by these vibrations is achieved by installation of a vibration isolator between a gaseous media nonreturn valve and a device for removing heat. Such a solution for use and location of installation of a vibration isolator is not evident for pulse combustion specialists, as the impact of gas flows rate change in a gaseous media nonreturn valve is out of consideration, while an explosive combustion in a combustion chamber is considered as the evident source of vibrations.

The shock wave is generated by a nonreturn valve. Taking a mechanical nonreturn valve as an example, the shock wave is generated as follows. During mechanical nonreturn valve closure, the membranes move from open valve position to a closed valve position by a return gas flow. As the membranes reach the closed state of the valve, the gas flow stops fast, almost instantly, generating a shock wave in a gas similar to hydraulic shock in hydraulic nonreturn valve closure. With that, a sharp pressure increase occurs on one side of a mechanical valve, while a sharp pressure decrease occurs on the other side of a valve. A valve sustains an impact similar to a shock by a hard object, the valve walls vibrate with their intrinsic resonant frequency. A shock wave spreads in a gaseous media in both directions from a nonreturn valve, generating vibration and noise of high intensity. A shock wave has a high energy, lasts for a short time and has a short front. A shock wave is generated at each pulse operating cycle of gas consumption. The time of a shock wave formation and its transitory processes is a lot shorter than a pulse operating cycle od as consumption. Thus, each shock wave behaves as a singular impact.

LIST OF DRAWINGS

PREFERABLE FORMS OF EMBODIMENT OF THE INVENTION

Figure 1:
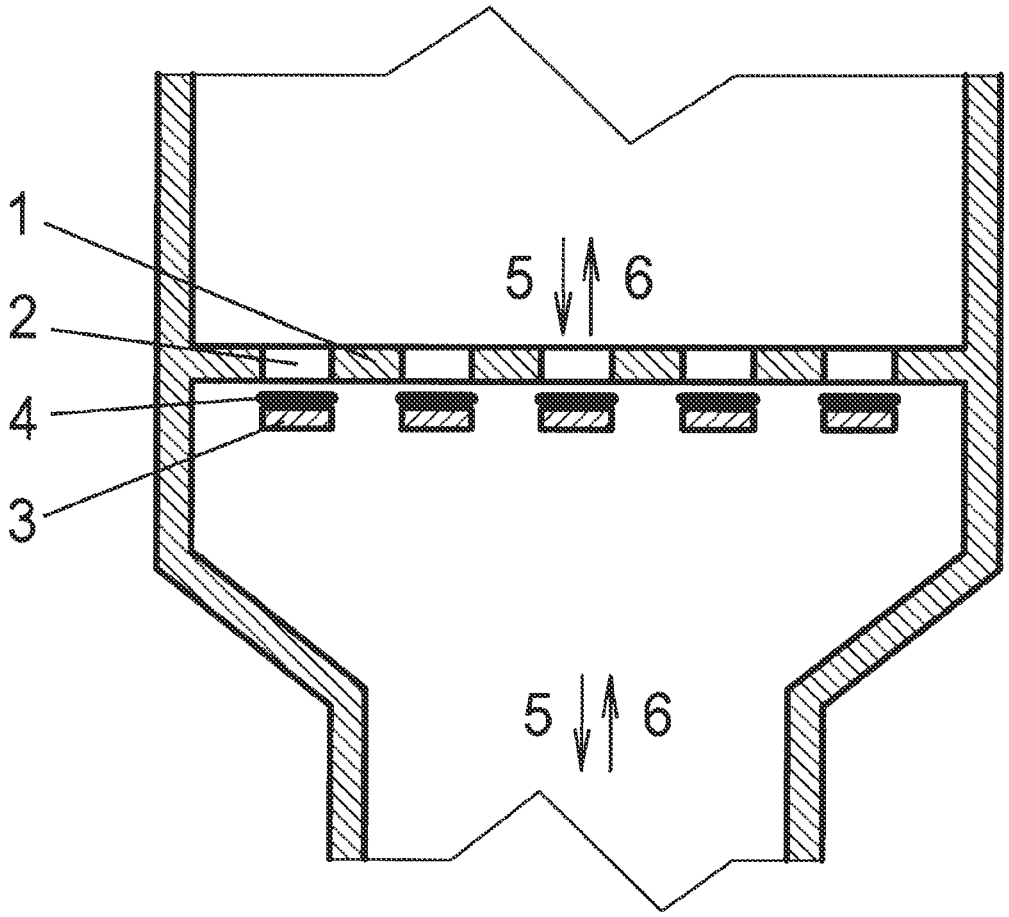
FIG. 1 shows a section of a mechanical gaseous media nonreturn valve.

Shock wave generation in gaseous media nonreturn valves is similar and will be described below using as an example a mechanical gaseous media nonreturn valve shown on FIG. 1. A mechanical nonreturn valve includes a plate 1 with control ports 2, guards 3 and membrane 4.

When a gaseous media moves in a forward direction 5, membranes 4 are pressed against guards 3 and control ports 2 of plate 1 are open. If a pressure gradient at a nonreturn valve changes, a gaseous media moves in an opposite direction 6, membranes 4 are moved by an opposite gaseous media flow from guards 3 to plate 1, covering control ports 2 in plate 1.

When membranes 4 reach plate 1 and cover control ports 2 in plate 1, the gas flow stops fast and almost instantly, generating a shock wave. With that, a sharp pressure increase occurs on one side of plate 1, while a sharp pressure decrease occurs on the other side of plate 1. Plate 1 sustains an impact similar to a shock by a hard object, and a shock wave spreads in a gaseous environment, generating a noise of high intensity.

Figure 2:
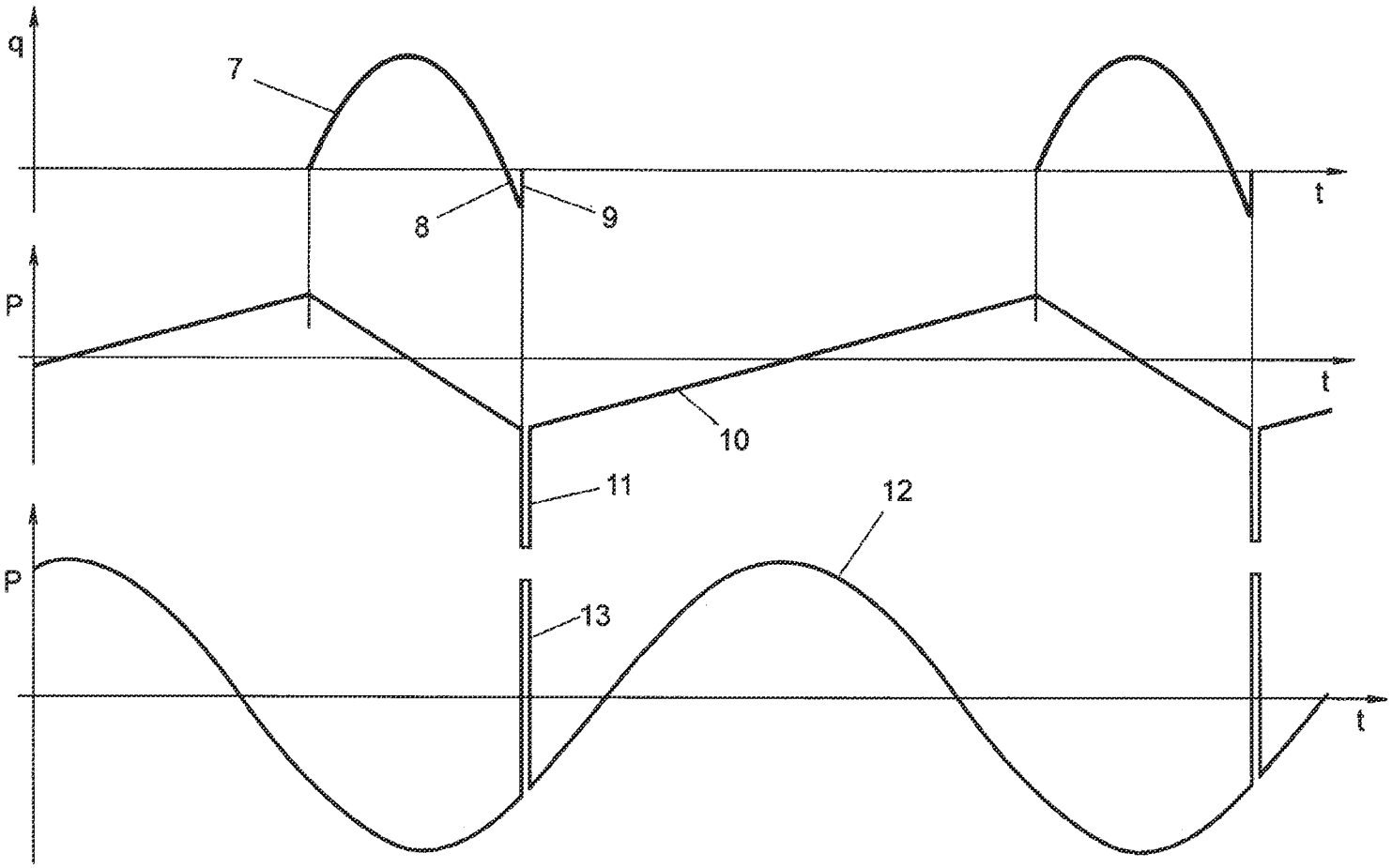
FIG. 2 shows graphs of gas flow and pressure variations when passing through a nonreturn valve.

FIG. 2 shows pressure and flow changes versus time in a nonreturn valve of a pulse combustion apparatus. Line 7 shows gas flow in forward direction, line 8 shows gas flow in opposite direction, line 9 shows a spike of velocity when a valve closes, line 10 shows pressure at a nonreturn valve inlet, line 11 shows a pressure drop surge generating a shock wave at gas inflow side, line 12 shows pressure at a nonreturn valve outlet, line 13 shows a pressure spike generating a shock wave at a nonreturn valve outlet.

A shock wave in pulse combustion apparatuses mostly impacts plate 1 of a nonreturn valve, similar to a shock by a hard object. As plate 1 has an intrinsic resonant frequency, plate 1 starts vibrating with this intrinsic frequency. When a shock wave of a next cycle impacts plate 1, plate 1 still continues to vibrate due to a previous shock wave impact, so the next shock wave increases the amplitude of plate 1 vibration. Plate 1 vibration amplitude increases until the energy added by shock waves equilibrates with energy loss of plate 1 vibration during the time between shock waves impacts. Vibration energy loss of plate 1 occurs due to plastic straining of plate 1, energy transformation to acoustic vibration of gas surrounding a valve and vibration transfer to all elements of a pulse combustion apparatus. Plate 1 of a valve is usually made of resilient material, thus losses due to plastic straining are small and nearly all the energy of a shock wave impact on valve plate 1 transforms to acoustic noise and vibration.

Vibrations of gaseous media nonreturn valve have a high intensity and spreading along the whole pulse combustion apparatus generate a high level of acoustic noise and vibration at the place of a pulse combustion apparatus installation and in connected heat-exchange agent, exhaust and air and fuel supply systems. The use of guarding and isolation of gaseous media nonreturn valves allows a significant decrease of acoustic noise and vibration generated by pulse combustion apparatuses. A maximum result is achieved by vibration isolation of nonreturn valves from all elements of a pulse combustion apparatus. In some cases, vibration isolation of gaseous media nonreturn valves from a device for removing heat will be enough, as it has a large radiation area, many connected elements, and a direct contact with a heat-exchange agent.

Pulse combustion apparatuses may have various forms of embodiment that differ by the mode of a combustion mixture formation and the type of nonreturn valves used.

Figure 3:
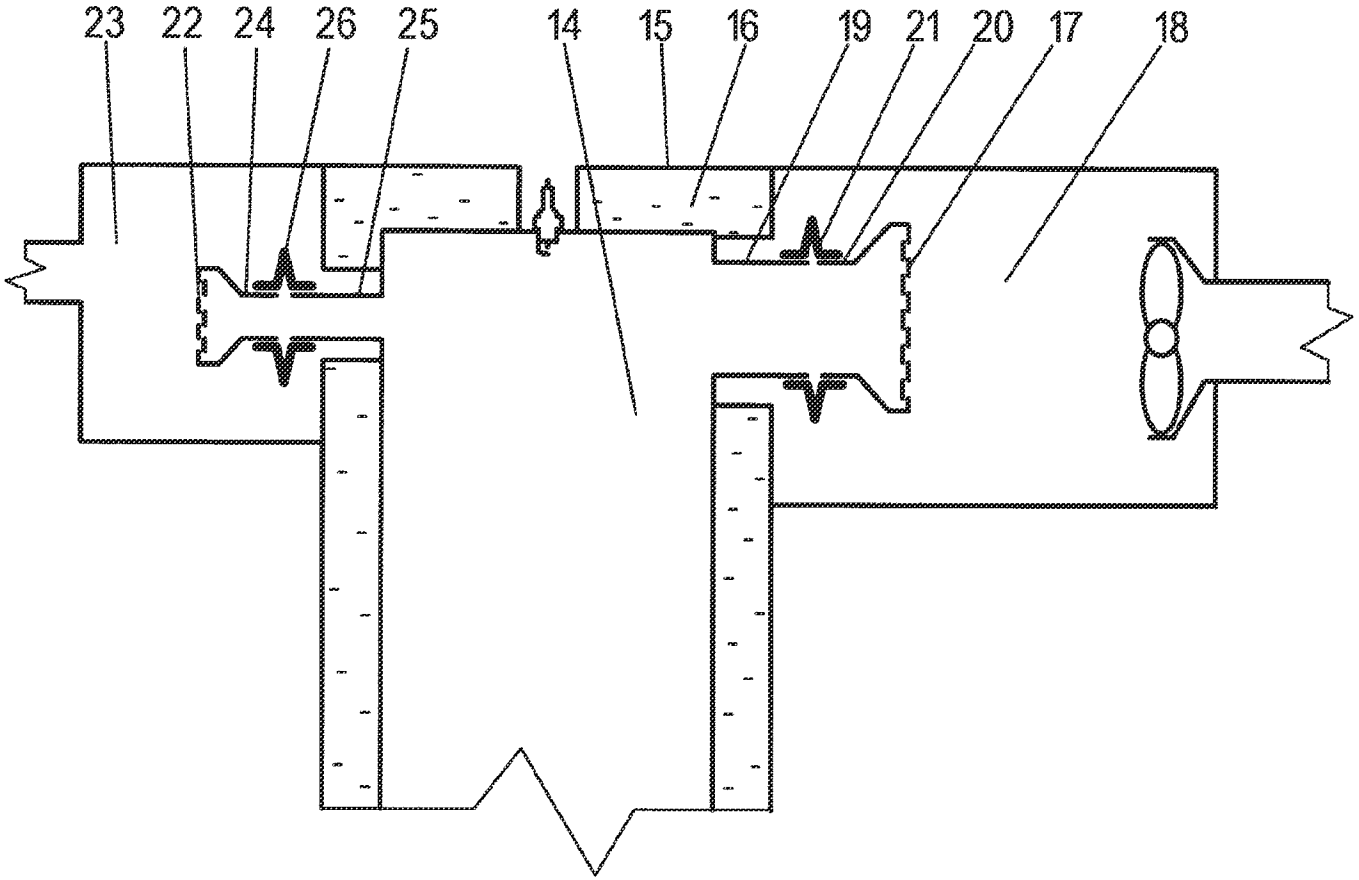
FIG. 3 shows a pulse combustion apparatus with a vibration isolation of air and combustion gas nonreturn valves with vibration isolator located between each nonreturn valve and a combustion chamber.

FIG. 3 shows a vibration isolation of combustion gas and air nonreturn valves from a device for removing heat indirectly via combustion chamber 14. Combustion chamber 14 is placed in a device for removing heat as a chamber 15 with liquid heat-exchange agent 16, the air nonreturn valve 17 is located in the guard chamber 18 and is connected to the combustion chamber 14 by connecting tubes 20 and 21, interconnected using a vibration isolator 19; combustion gas nonreturn valve 22 is located in the guard chamber 23 and is connected with the combustion chamber 14 by connection tubes 25 and 26, interconnected using vibration isolator 24. Vibration isolators 19 and 24 are a non-supportive link executed as corrugated cylinders.

Figure 4:
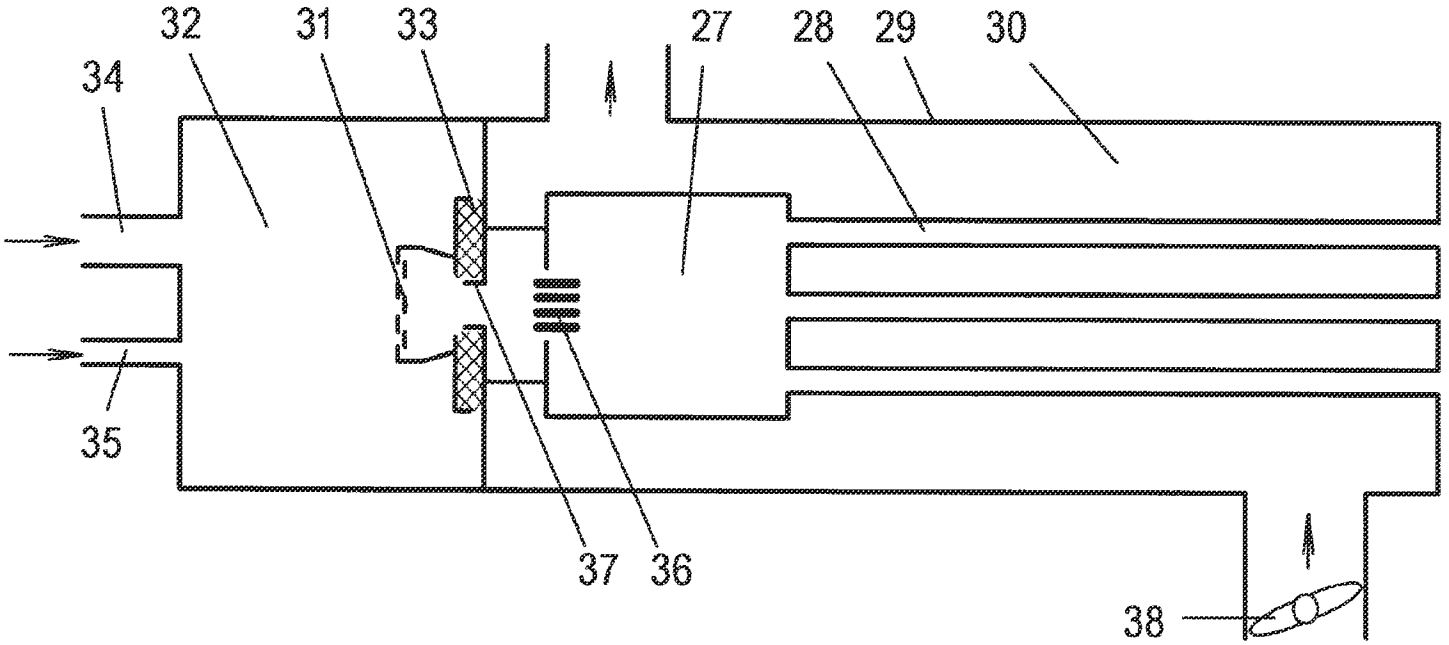
FIG. 4 shows a pulse combustion apparatus with a vibration isolation of a combustion mixture nonreturn valve, a form of embodiment with a direct connection of a nonreturn valve and heat-exchange agent chamber via a supporting vibration isolator.

FIG. 4 shows combustion chamber 27 and resonant channel as resonant tubes 28 placed in the device for removing heat as chamber 29 with a gaseous heat-exchange agent 30. Combustion mixture nonreturn valve 31 is placed in the guard chamber 32 and is connected with chamber 29 of the device for removing heat indirectly using vibration isolator 33, which is a supportive link executed as a support made of elastic material, preferably foam rubber. A combustion mixture is formed in the guard chamber 32 and includes air supplied by pipe 34 and combustion gas supplied by pipe 35. Combustion mixture is supplied to the combustion chamber 27 via the flame damper 36. Screen 37 protects vibration isolator 33 from a high temperature of gas flow reverse bursts from the combustion chamber 27. Ventilator 38 provides a heat-exchange agent flow.

Figure 5:
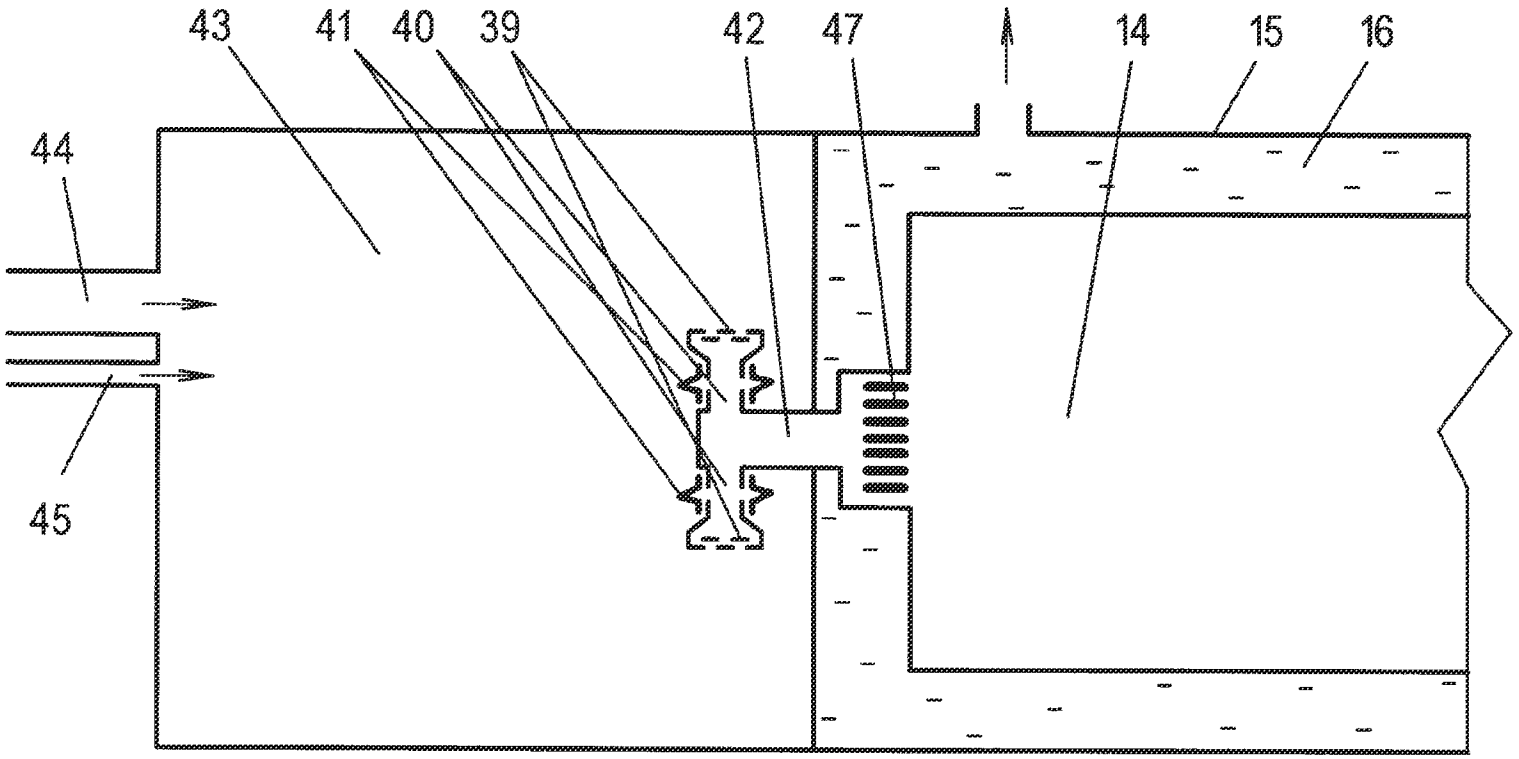
FIG. 5 shows a pulse combustion apparatus with two combustion mixture nonreturn valves with a vibration isolation of each combustion mixture nonreturn valve.

FIG. 5 shows the combustion chamber 14 placed in the device for removing heat as chamber 15 with a liquid heat-exchange agent 16; combustion mixture nonreturn valves 39 are connected via connecting tubes 40 and vibration isolators 41 with tube 42, connected to the guard chamber 43, which is rigidly connected to chamber 15. There may be one to four combustion mixture nonreturn valves 39. A combustion mixture is formed in the guard chamber 43 and includes air supplied by pipe 44 and combustion gas supplied by pipe 45. Combustion mixture is supplied to the combustion chamber 14 via the flame damper 47.

Figure 6:
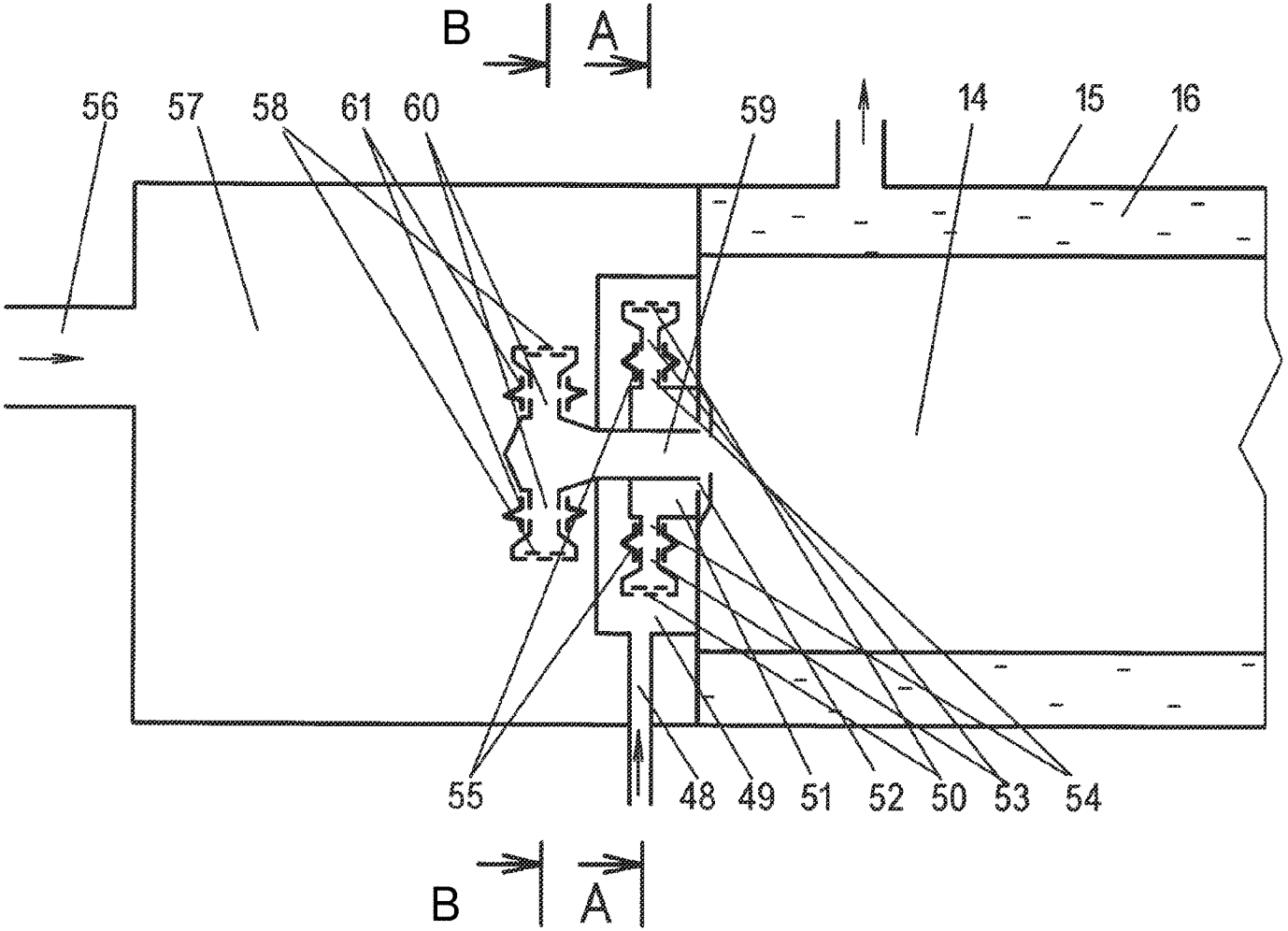
FIG. 6 shows a pulse combustion apparatus with a vibration isolation of four air nonreturn valves and four combustion gas nonreturn valves.

Several nonreturn valves may be installed in parallel for one gaseous media, as shown in FIG. 6. FIG. 6 shows a combustion chamber 14 placed in the device for removing heat as chamber 15 with a liquid heat exchange agent 16; combustion gas is supplied by pipe 48 to the guard chamber 49 of combustion gas nonreturn valves 50; combustion gas through nonreturn valves 50 is supplied to the circular chamber 51, from which it is supplied to the combustion chamber 14 through the circular hole 52. Combustion gas nonreturn valves 50 are connected to the circular chamber 51 by connecting pipes 53 and 54, interconnected by vibration isolators 55. The air is supplied by tube 56 to the guard chamber 57 of air nonreturn valves 58 and, through air nonreturn valves 58 is supplied to the combustion chamber 14 via convergent-divergent tube 59 passing through the guard chamber 49 of nonreturn valves 50. Air nonreturn valves 58 are connected to tube 59 by connecting tubes 60 and vibration isolators 61. Combustion chamber 14 is rigidly connected to the device for removing heat as chamber 15 for heat-exchange agent 16.

Figure 7:
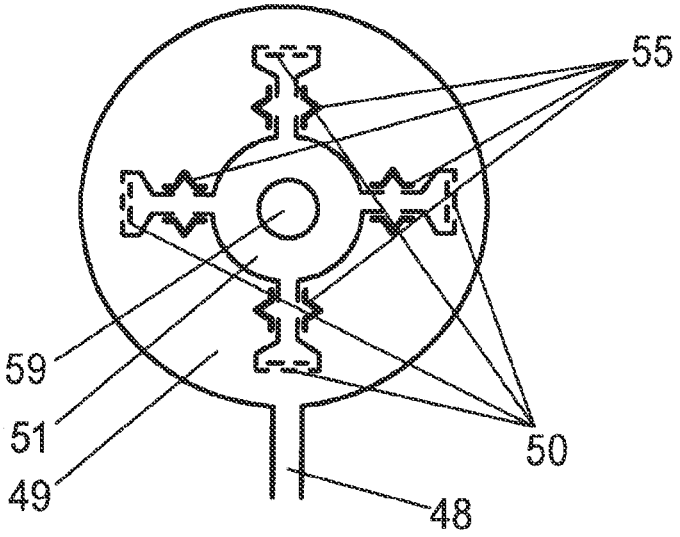
FIG. 7 shows A-A section on FIG. 6 for placing four combustion gas nonreturn valves in one guard chamber.
Figure 8:
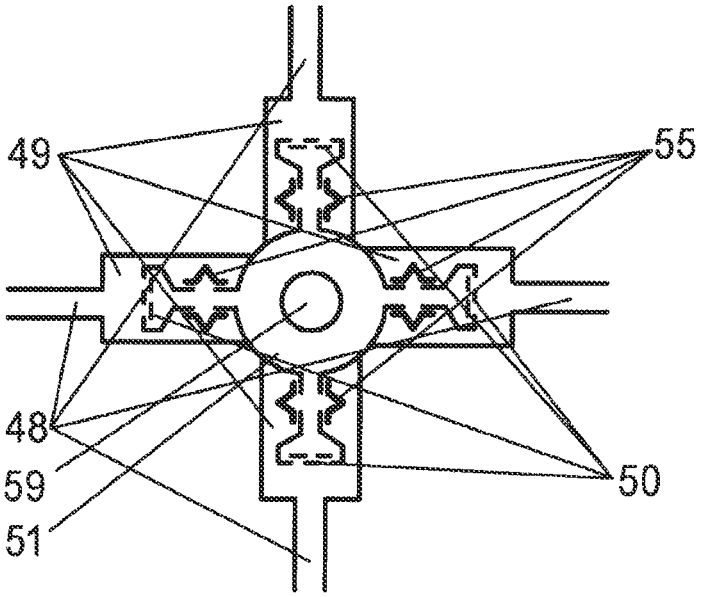
FIG. 8 shows A-A section on FIG. 6 for placing four combustion gas nonreturn valves in different guard chambers.
Figure 9:
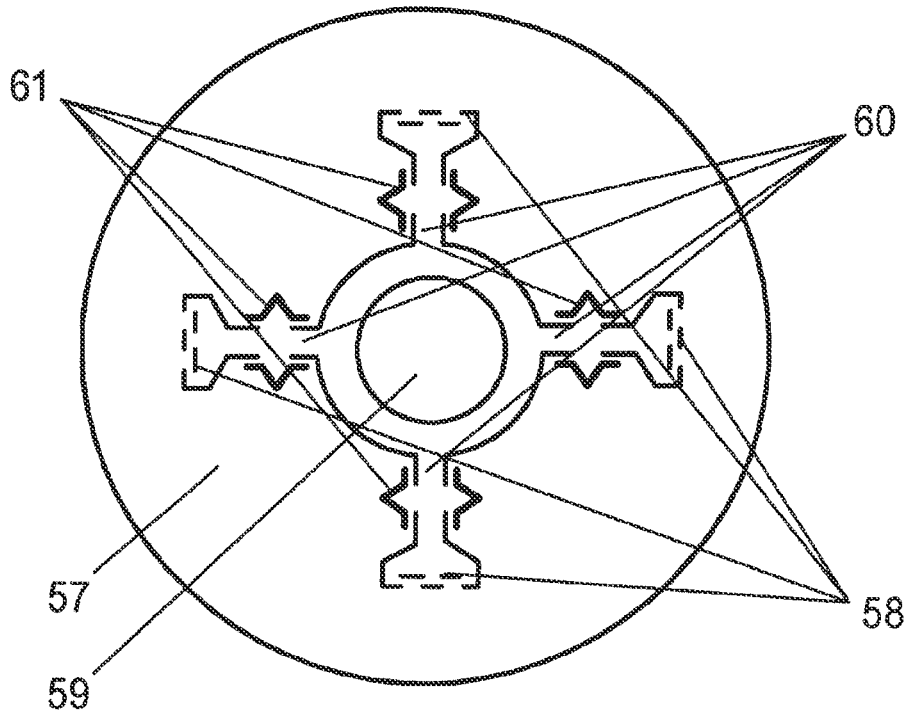
FIG. 9 shows B-B section on FIG. 6 for placing four air nonreturn valves in one guard chamber.
Figure 10:
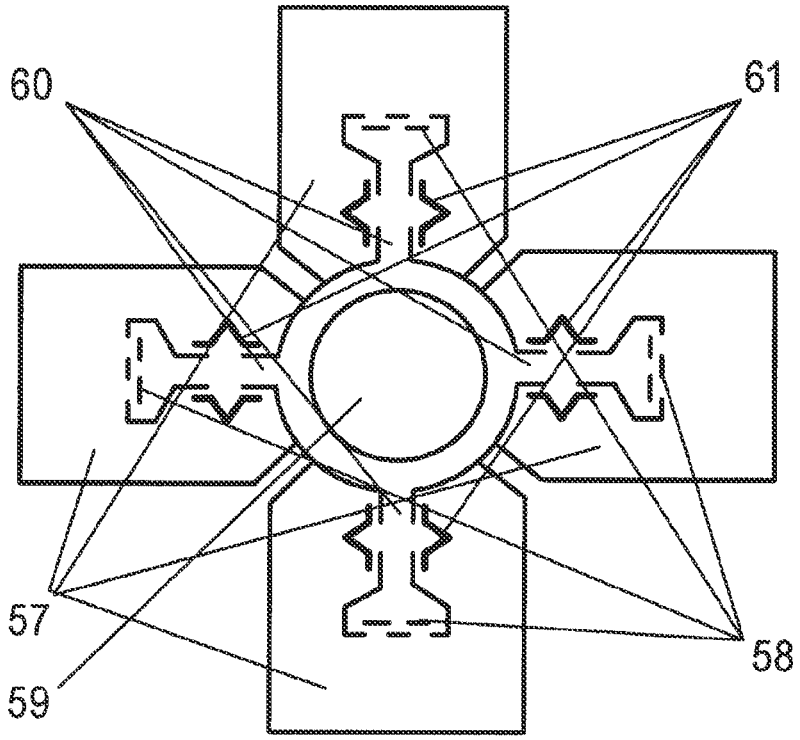
FIG. 10 shows B-B section on FIG. 6 for placing four air nonreturn valves in different guard chambers.

Nonreturn valves of one gaseous media installed in parallel may be placed in one guard chamber, or each nonreturn valve may be placed in an individual guard chamber. FIG. 7 shows section A-A on FIG. 6 for nonreturn valves 50 installed in one guard chamber 49. FIG. 8 shows section A-A on FIG. 6 for nonreturn valves 50, each installed in an individual guard chamber 49. FIG. 9 shows section B-B on FIG. 6 for nonreturn valves 58 installed in one guard chamber 57. FIG. 10 shows section B-B on FIG. 6 for nonreturn valves 58, each installed in an individual guard chamber 57.

Figure 11:
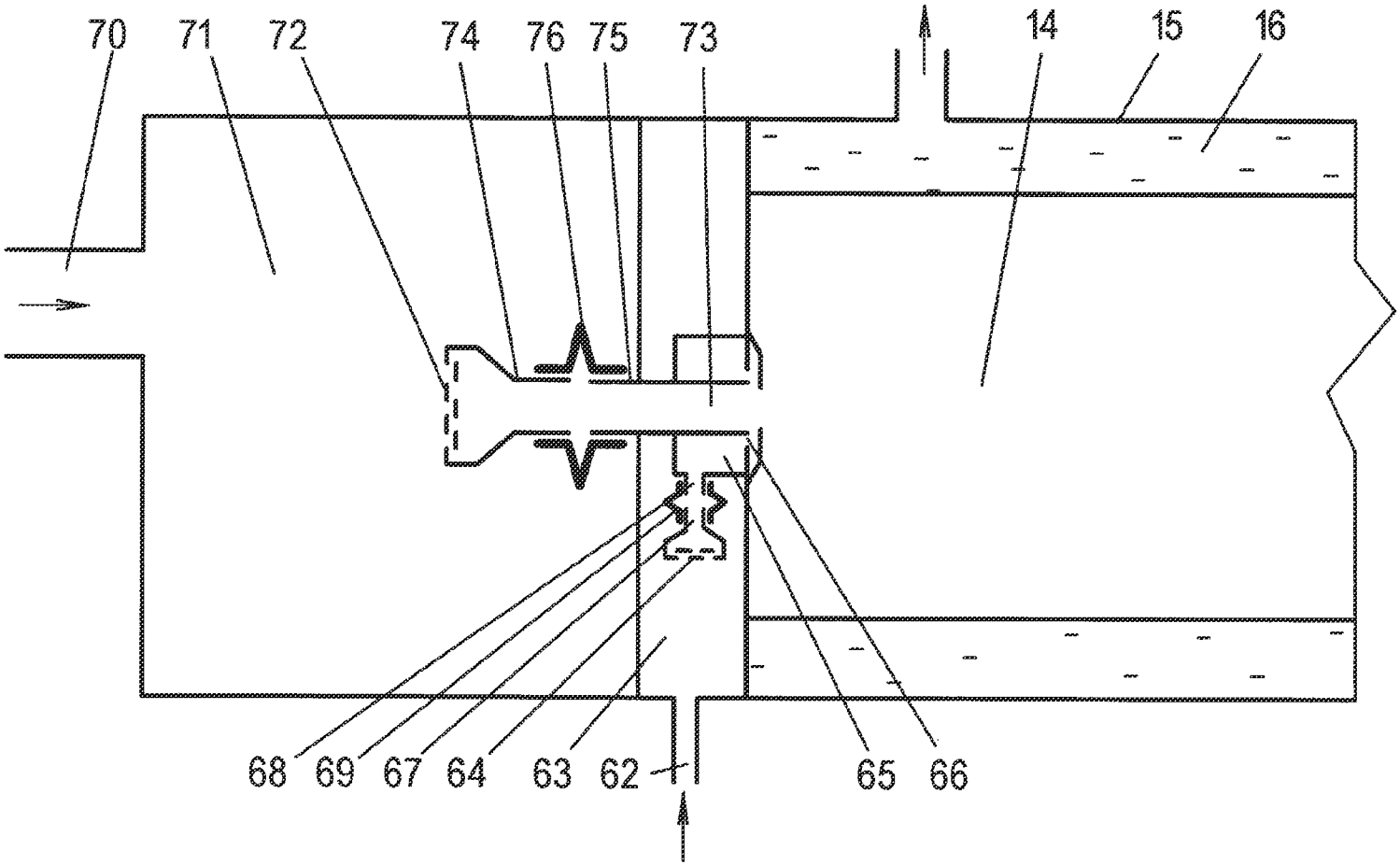
FIG. 11 shows the same as FIG. 6 with one air nonreturn valve and one combustion gas nonreturn valve.

FIG. 11 shows the combustion chamber 14 placed in the device for removing heat as chamber 15 with a liquid heat-exchange agent 16. Combustion gas is supplied by pipe 62 to the guard chamber 63 of combustion gas nonreturn valve 64; combustion gas through nonreturn valve 64 is supplied to the circular chamber 65, from which it is supplied to the combustion chamber 14 through the circular hole 66. Combustion gas nonreturn valve 64 is connected to the circular chamber 65 by connection tubes 67 and 68 interconnected by vibration isolator 69. The air is supplied via pipe 70 to guard chamber 71 of air nonreturn valve 72; through valve 72 the air is suppled to combustion chamber 14 via pipe 73. The air nonreturn valve 72 outlet is connected to the guard chamber 71 outlet by connection tubes 74 and 75 interconnected using vibration isolator 76; the guard chamber 71 is rigidly connected to the guard chamber 63 of combustion gas nonreturn valve 64, while the guard chamber 63 is rigidly connected to the device for removing heat as chamber 15 for a heat-exchange agent 16.

Figure 12:
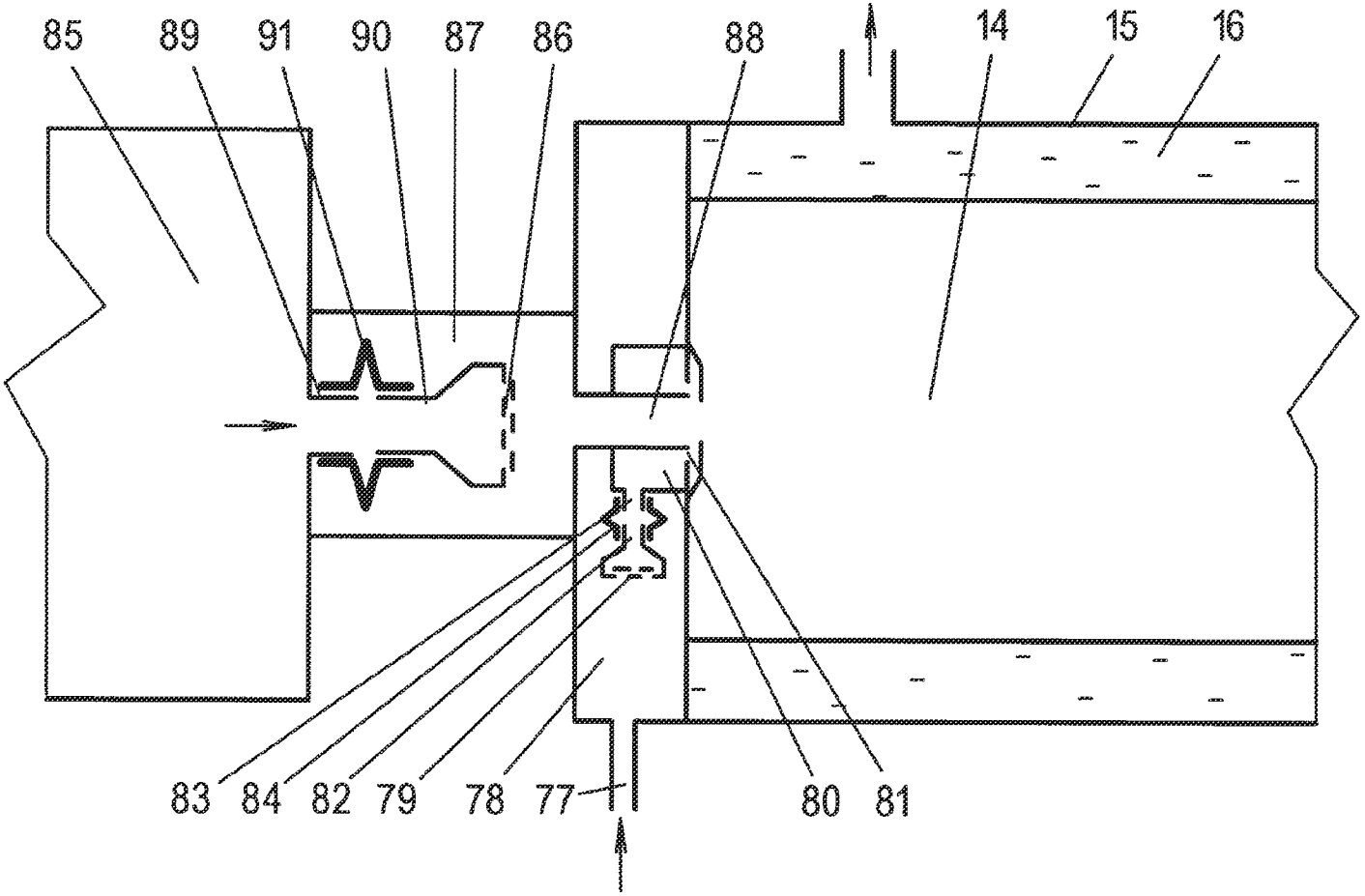
FIG. 12 shows a pulse combustion apparatus with a vibration isolation of air and combustion gas nonreturn valves, a variant with vibration isolator located between air nonreturn valve inlet and air nonreturn valve guard chamber.

FIG. 12 shows the combustion chamber 14 placed in the device for removing heat as chamber 15 with a liquid heat-exchange agent 16. Combustion gas is supplied by pipe 77 to the guard chamber 78 of combustion gas nonreturn valve 79; combustion gas through nonreturn valve 79 is supplied to the circular chamber 80, from which it is supplied to the combustion chamber 14 through the circular hole 81. Combustion gas nonreturn valve 79 is connected to the circular chamber 80 by connection tubes 82 and 83 interconnected by vibration isolator 84. The air from pressure stabilization chamber 85 through the nonreturn valve 86 is supplied to the guard chamber 87 and then is supplied to combustion chamber 14 via pipe 88. The air nonreturn valve 86 inlet is connected to the guard chamber 85 inlet by connection tubes 89 and 90 interconnected using vibration isolator 91; the guard chamber 87 is rigidly connected to the guard chamber 78 of combustion gas nonreturn valve 79, while the guard chamber 78 is rigidly connected to the device for removing heat as chamber 15 for a heat-exchange agent 16.

Figure 13:
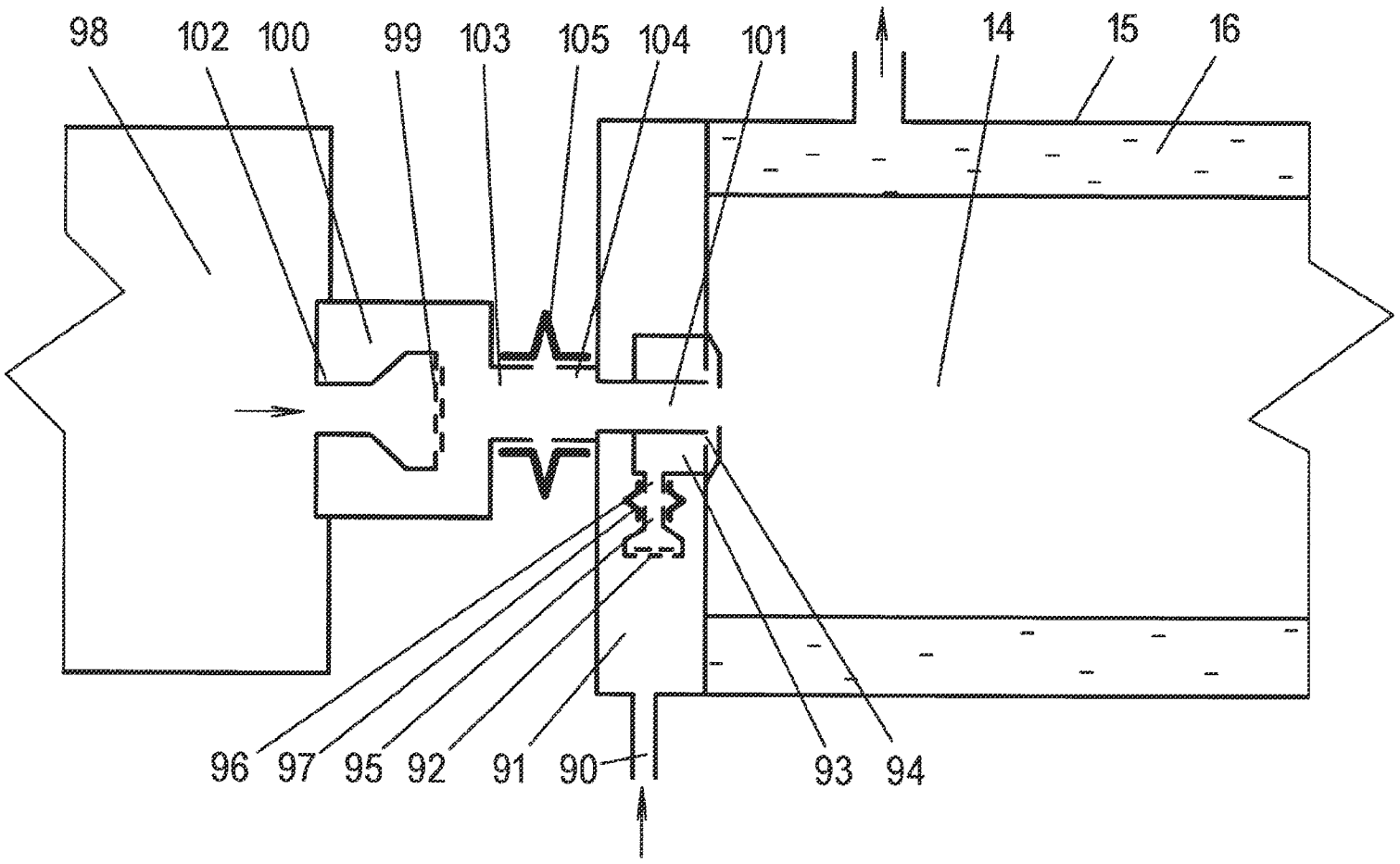
FIG. 13 shows a pulse combustion apparatus with a vibration isolation of air and combustion gas non-return valves, a variant with a vibration isolation located between guard chambers of air non-return valve and combustion mixture non-return valve.

FIG. 13 shows the combustion chamber 14 placed in the device for removing heat as chamber 15 with a liquid heat-exchange agent 16. Combustion gas is supplied by pipe 90 to the guard chamber 91 of combustion gas nonreturn valve 92; combustion gas through nonreturn valve 92 is supplied to the circular chamber 93, from which it is supplied to the combustion chamber 14 through the circular hole 94. Combustion gas nonreturn valve 92 is connected to the circular chamber 93 by connection tubes 95 and 96 interconnected by vibration isolator 97. The air from pressure stabilization chamber 98 through the air nonreturn valve 99 is supplied to the guard chamber 100 and then is supplied to combustion chamber 14 via pipe 101. The air nonreturn valve 99 inlet is rigidly connected to the guard chamber 100 inlet by connecting tube 102; the guard chamber 100 is connected to the guard chamber 91 of combustion gas nonreturn valve 92 by connecting tubes 103 and 104, interconnected by vibration isolator 105, while the guard chamber 91 is rigidly connected to the device for removing heat as chamber 15 for a heat-exchange agent 16.

Figure 14:
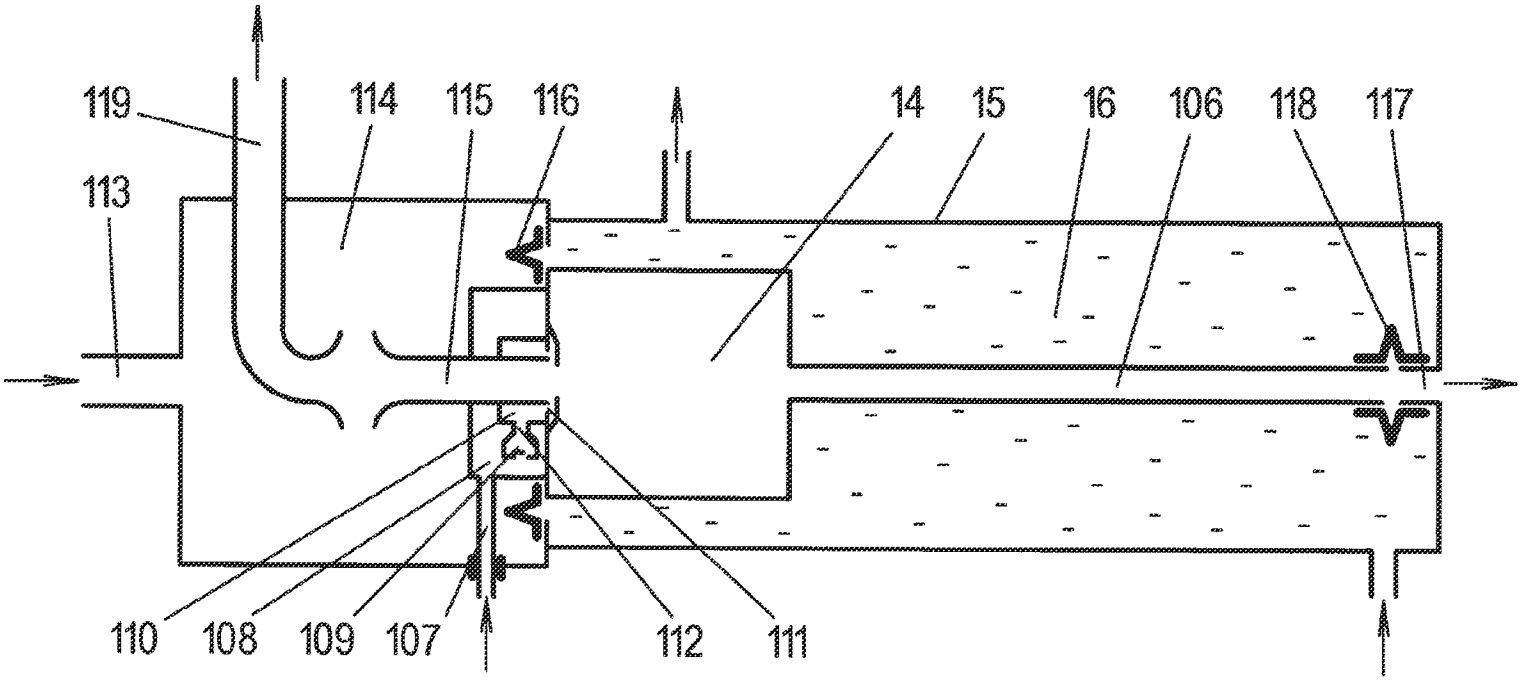
FIG. 14 shows a pulse combustion apparatus with a vibration isolation of an aerodynamic air nonreturn valve, a variant with one vibration isolation located between a combustion chamber and a chamber for heat exchange agent and another vibration isolation located between a resonant pipe and a chamber for heat exchange agent.

Besides mechanical gaseous media nonreturn valves, aerodynamic gaseous media nonreturn valves may be used. FIG. 14 shows the combustion chamber 14 and resonant tube 106 placed in the device for removing heat as chamber 15 with liquid heat-exchange agent 16. Combustion gas is supplied by pipe 107 to the guard chamber 108 of combustion gas nonreturn valve 109; combustion gas through nonreturn valve 109 is supplied to the circular chamber 110, from which it is supplied to the combustion chamber 14 through the circular hole 111. Combustion gas nonreturn valve 109 is connected to the circular chamber 110 by the connection tube 112. The air via tube 113 is supplied in the guard chamber 114 of aerodynamic air nonreturn valve 115; the air is supplied to combustion chamber 14 via the nonreturn valve 115. Aerodynamic air nonreturn valve 115 outlet is rigidly connected to the combustion chamber 14, the guard chamber 114 is rigidly connected to the device for removing heat as chamber 15 for heat-exchange agent 16. Combustion chamber 14 is connected to the device for removing heat as chamber 15 for a heat-exchange agent 16 by the vibration isolator 116, here connecting the wall of the combustion chamber 14 and the wall of chamber 15 of the device for removing heat. The resonant channel outlet executed as tube 106 is connected to the device for removing heat as chamber 15 with a heat-exchange agent 16 by the connecting tube 117 and the vibration isolator 118, connecting the resonant tube 106 to connecting tube 117. Tube 119 vacates reverse gas flows of an aerodynamic valve.

Figure 15:
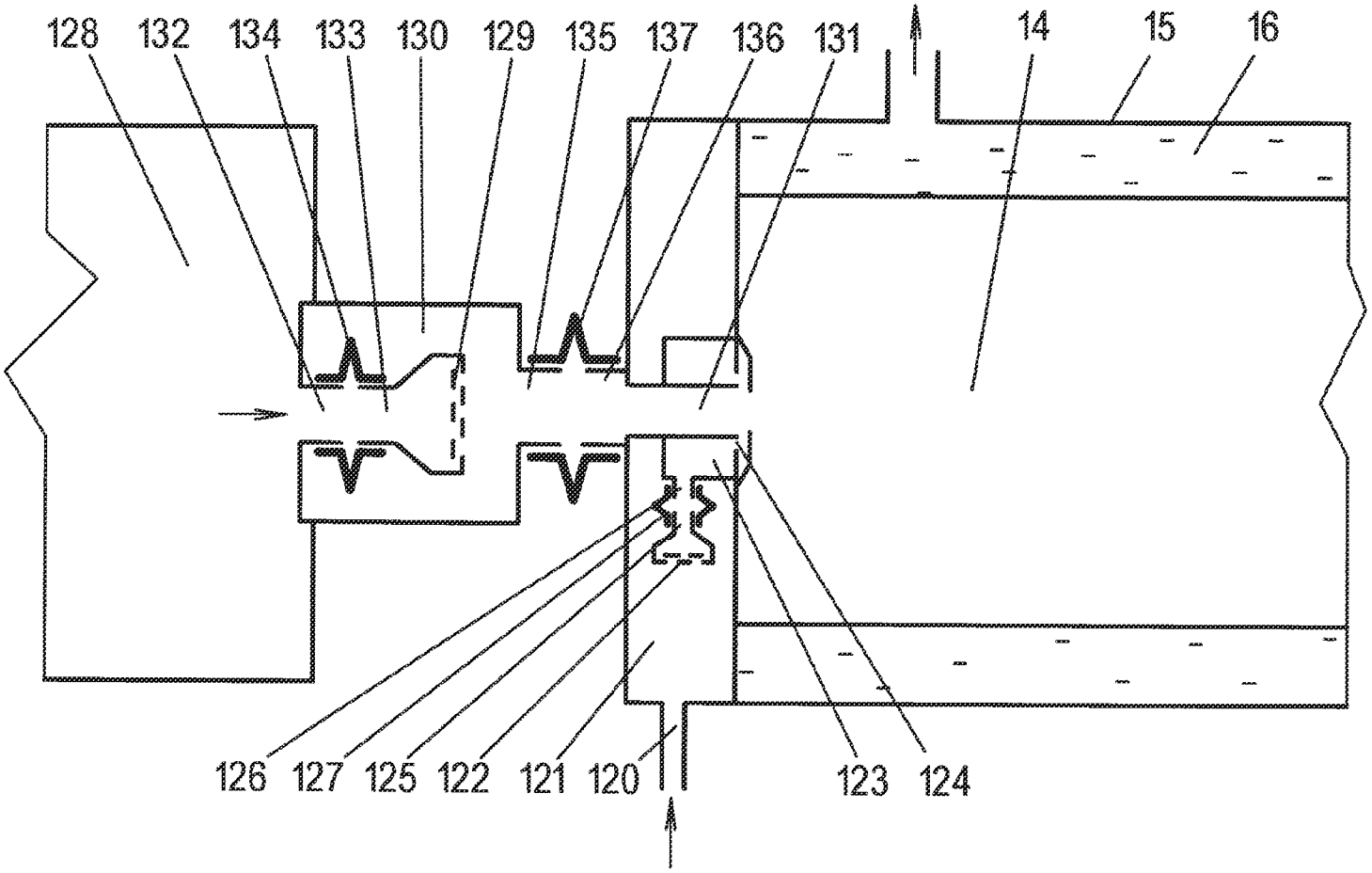
FIG. 15 shows a pulse combustion apparatus with a vibration isolation of air and combustion gas nonreturn valves, a variant with a consecutive location of two vibration isolators between an air nonreturn valve and a guard chamber of an air valve and between a guard chamber of an air valve and a guard chamber of a combustion gas nonreturn valve.

FIG. 15 shows a use of two consecutively located vibration isolators connecting the air nonreturn valve to the device for removing heat executed as a chamber for a heat-exchange agent. Combustion chamber 14 placed in the device for removing heat as chamber 15 with a liquid heat-exchange agent 16. Combustion gas is supplied by pipe 120 to the guard chamber 121 of combustion gas nonreturn valve 122; combustion gas through nonreturn valve 122 is supplied to the circular chamber 123, from which it is supplied to the combustion chamber 14 through the circular hole 124. Nonreturn valve 122 is connected to the circular chamber 123 by connecting tubes 125 and 126 and the vibration isolator 127. The air from pressure stabilization chamber 128 through the nonreturn valve 129 is supplied to the guard chamber 130 and then is supplied to combustion chamber 14 via pipe 131. The air nonreturn valve 129 inlet is connected to the guard chamber 130 inlet by connecting tubes 132 and 133, interconnected by the vibration isolator 134; the guard chamber 130 is connected to the guard chamber 121 of combustion gas nonreturn valve 122 by connecting tubes 135 and 136, interconnected by vibration isolator 137, while the guard chamber 121 is rigidly connected to the device for removing heat as chamber 15 for a heat-exchange agent 16.

Figure 16:
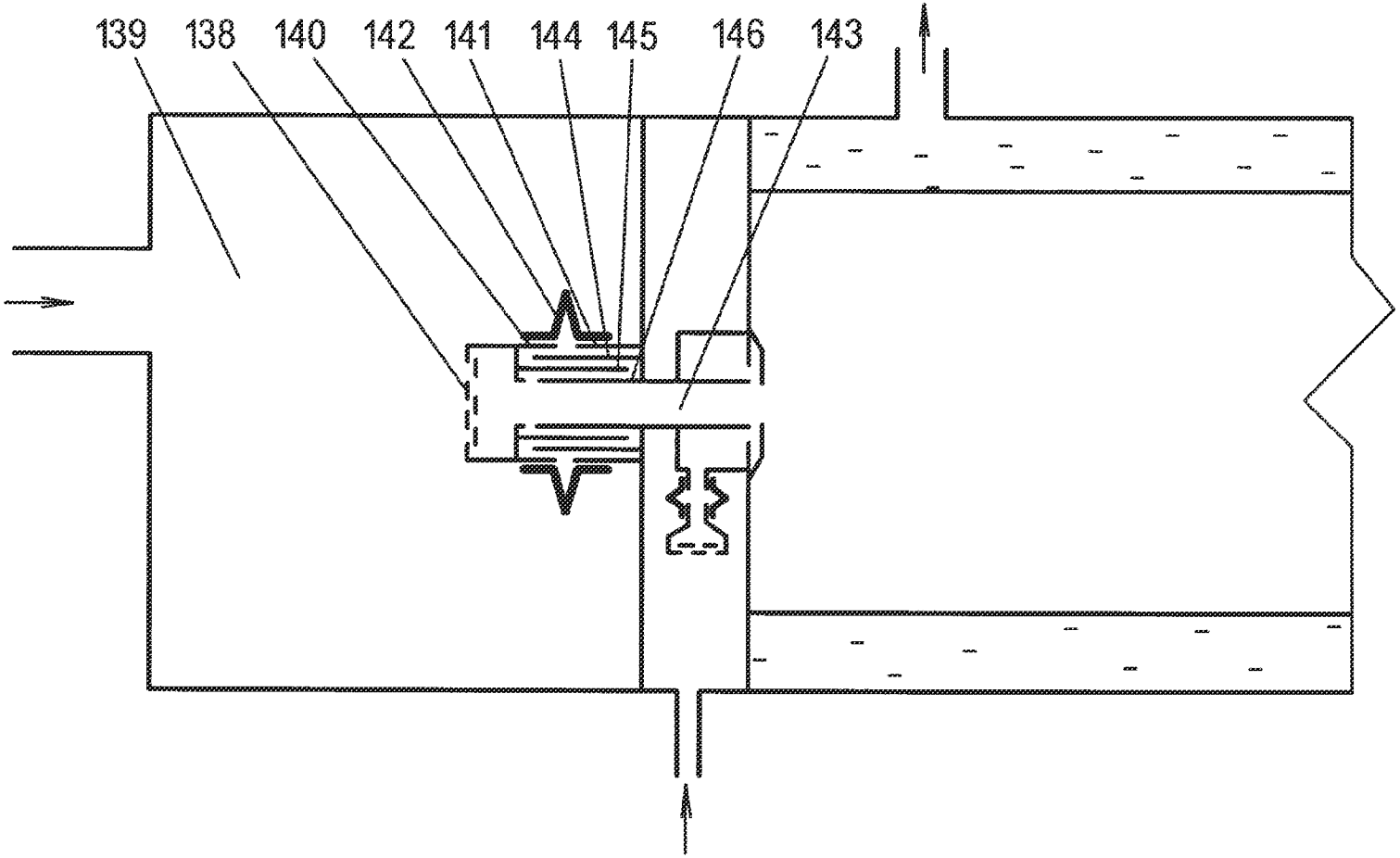
FIG. 16 shows a pulse combustion apparatus with a vibration isolation of air and combustion gas nonreturn valves, a variant with a maze located between a vibration isolator and a tube supplying air to combustion chamber.

Vibration isolators should meet the requirements for airtightness, durability, and heat-resistance. In order to increase a vibration isolator heat-resistance and protect it from back surges of hot combustion products, a vibration isolator is protected by a maze. A maze is a series of concentrical cylindrical screens located with gaps and forming a long and narrow gaseous media canal between a vibration isolator and the main flow of a gaseous media. FIG. 16 shows the air nonreturn valve 138 connected to the guard chamber 139 by connection tubes 140 and 141 interconnected by the vibration isolator 142. A maze is located between vibration isolator 142 and air supply tube 145, formed by coaxial connecting tubes 143 and 144 that protect the vibration isolator 142 from hot gases flow in tube 146.

Figure 17:
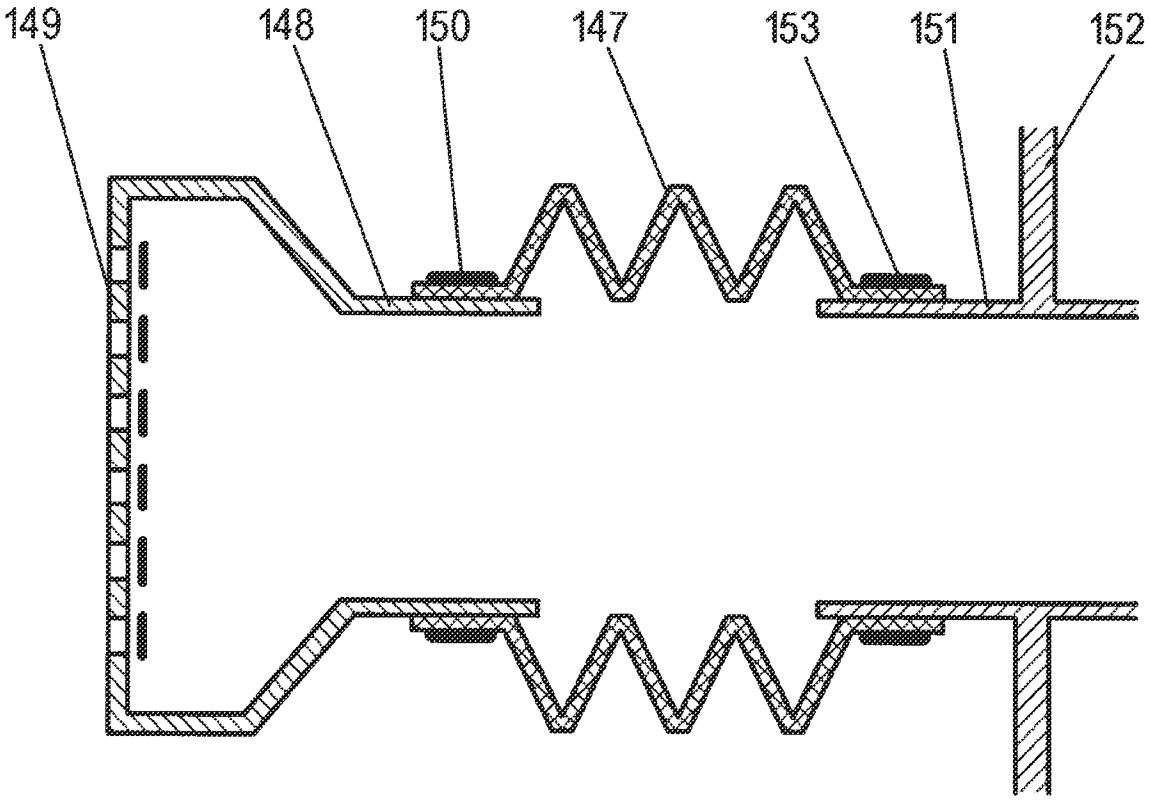
FIG. 17 shows a vibration isolator executed as a cylinder-shaped element with corrugations.

FIG. 17 shows a vibration isolator 147 executed as cylinder-shaped corrugated element—bellows made of any material meeting the requirements stated above. Vibration isolator 147 is fixed to the connection pipe 148 of the nonreturn valve 149 by the clamp 150, and to the connecting pipe 151 of the guard chamber 152 by clamp 153. Vibration isolator may be executed as a cylinder-shaped element with one transversal corrugation, as shown on FIG. 3-16.

Figure 18:
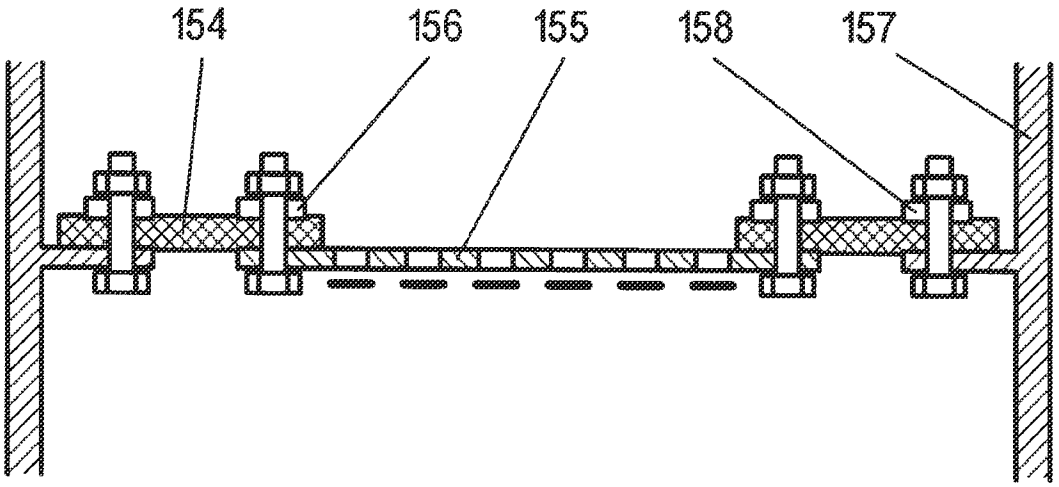
FIG. 18 shows a vibration isolator executed as a flat circular membrane.

FIG. 18 shows a vibration isolator 154 executed as a flat circular membrane made of any material meeting the requirements stated above. Vibration isolator 154 is fixed to the nonreturn valve 155 with the annular gasket 156, and to guard chamber 157 with the annular gasket 158. Vibration isolator may also be executed as a circular membrane with one or more circular corrugation as shown in FIG. 4.

Figure 19:
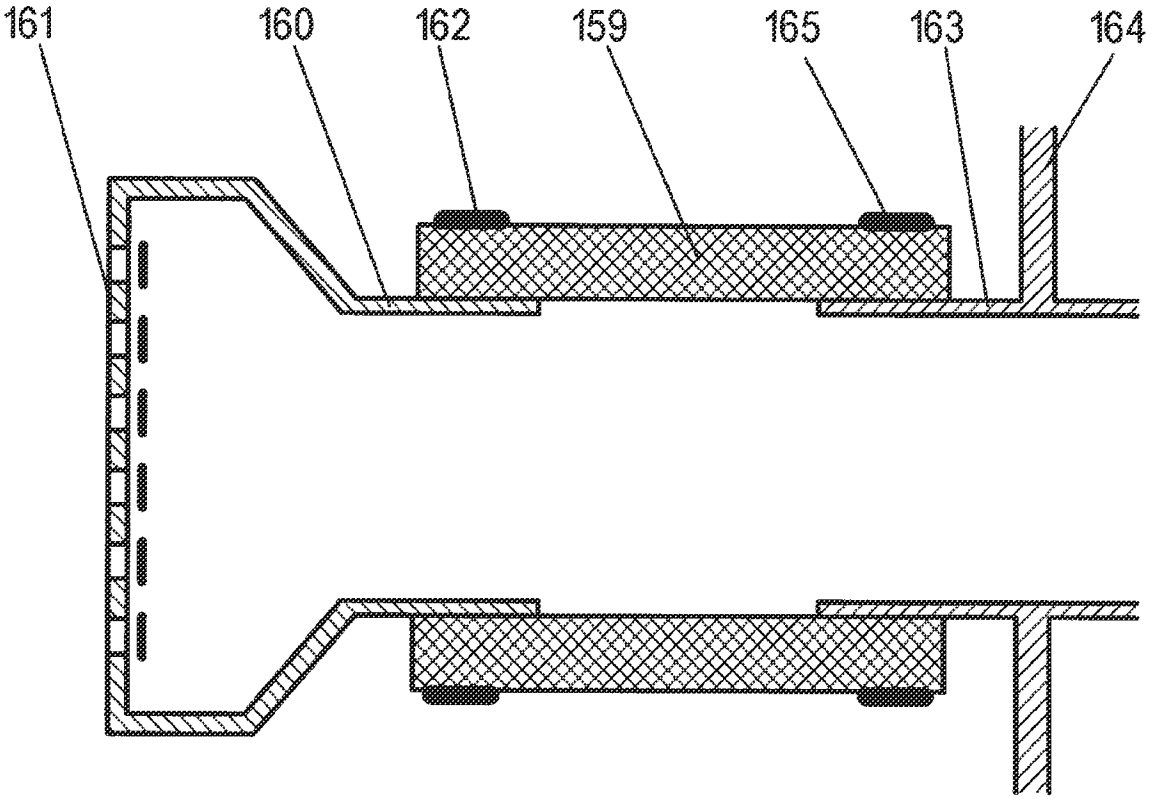
FIG. 19 shows a vibration isolator executed as a cylinder-shaped element made of elastic material.

FIG. 19 shows a vibration isolator 159 executed as a cylinder-shaped element made of elastic material, providing the necessary airtightness, durability, and heat-resistance. Vibration isolator 159 is fixed to the connection pipe 160 of the nonreturn valve 161 by the clamp 162, and to the connecting pipe 163 of the guard chamber 164 by clamp 165.

In a preferrable form of embodiment of the current invention, a vibration isolator is executed as a cylinder-shaped corrugated element, a bellows made of rubber with wall thickness of 2 to 5 mm.

The shock wave in pulsation combustion apparatuses is generated at all gaseous media reverse mechanical valves. The shock wave intensity depends on flow characteristics of nonreturn valves.

Figure 20:
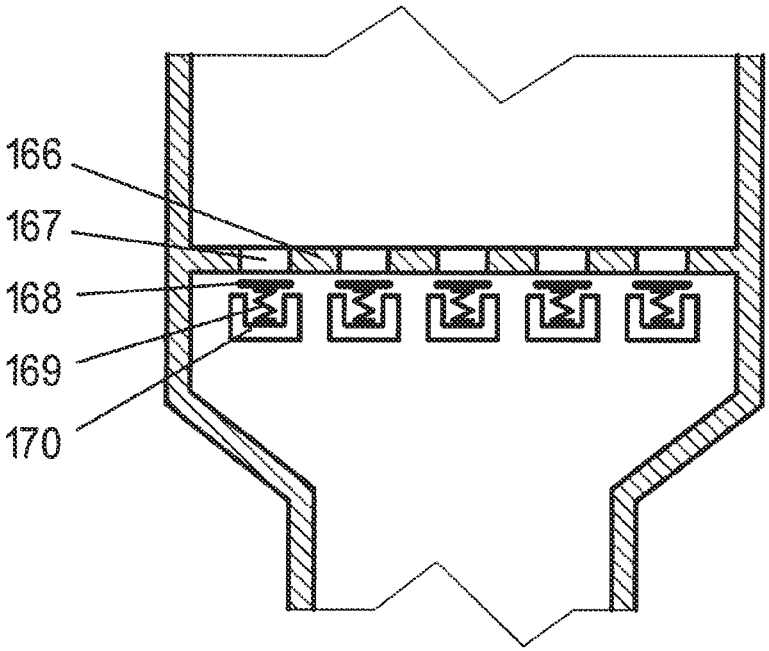
FIG. 20 shows a gaseous media nonreturn valve with membranes pressured by springs.

To decrease the intensity of a shock generated by a gas flow, changes, if possible, are introduced to a design of a node generating shock in a gaseous media. For example, the intensity of a shock will be decreased if membranes of gaseous media nonreturn valve will be spring-loaded in the closing direction, leading to a decrease of reverse flow velocity at the time of a nonreturn valve closing. FIG. 20 shows a design of a nonreturn valve, where membranes 168 are pressed against plate 166 with control ports 167 by springs 169, located in membranes guards 170.

Figure 21:
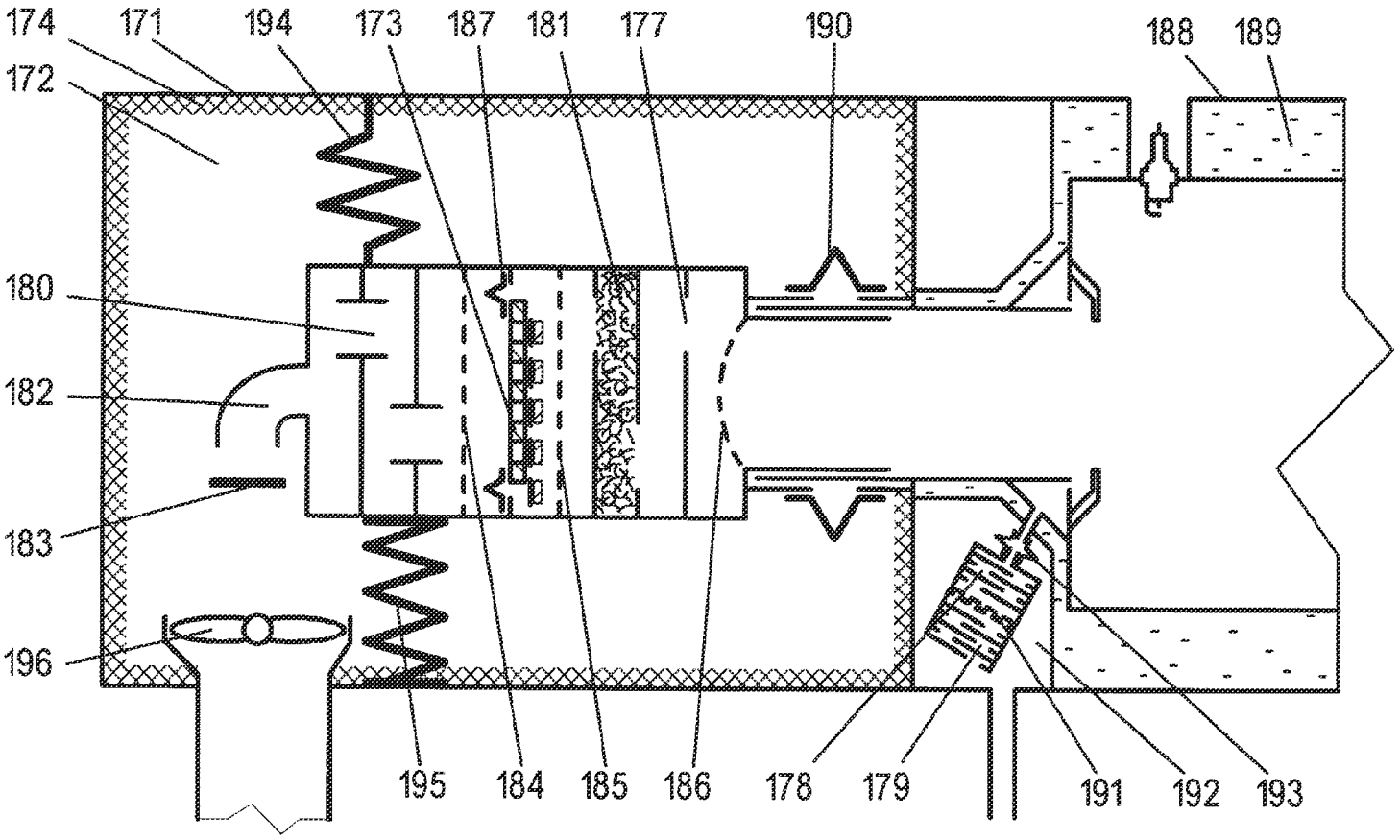
FIG. 21 shows a pulse combustion apparatus with non-return valves connected to shock wave dampers of various forms of embodiment.

Acoustic noise generated by operating pulsations of gas flow, a shock wave and vibration of gaseous media nonreturn valve walls in a closed space are reflected multiple times from the internal surface of a guard chamber walls, thus, the noise transfers almost all the energy to guard chamber walls vibration. These vibrations spread as vibrations and acoustic noise of the external surface of a guard chamber walls. For effective reverberation absorption, the internal walls of a guard chamber may be lined by a sound absorbing material. FIG. 21 shows walls 171 of the guard chamber 172 of the air nonreturn valve 173 lined with a sound absorbing material 174 with heat isolation properties.

The use of rigid structures of cavities and channels allows to decrease the level of noise generated by a shock wave impact on cavities and channels walls. For example, cylindrical and spherical walls generate less noise at a shock wave impact as compared to flat walls with the same thickness.

According to the current invention, acoustic low pass filters may be used to decrease the effect of a shock wave. The properties of low pass filters are similar to the properties of low pass filters in electrical engineering, which are well known and studied.

Acoustic low pass filter effects the gas flow variability depending on a frequency. Acoustic low pass filter has a cut-off frequency. A filter does not affect oscillations with a frequency below a cut-off value and decrease the amplitude of oscillations of gas flow with a frequency above the cut-off value.

To decrease the effect of a shock wave at a gaseous media mechanical nonreturn valve inlet and outlet, shock wave dampers may be installed sequentially. FIG. 21 show shock wave dampers as acoustic low pass filters 177, 178 and 179, respectively, executed as small chambers with non-coaxial inlets and outlets and connected by holes and/or slots, and acoustic low pass filters 180, executed as small chambers and connected by short pipes. Here acoustic low pass filters are selected with a cut-off frequency above a pulsation frequency of a pulse combustion apparatus. Besides, shock wave dampers may be executed as metallic wool 181 or bended pipe 182 with a channel curve, solid screens 183 or perforated screens 184, 185 and 186 installed along the path of a shock wave spread. Solid screen 183 is installed with a gap relative to channel walls. Shock wave dampers may be linked to a nonreturn valve using the vibration isolator 187.

The walls of shock wave dampers and the walls of a guard chamber of a gaseous media nonreturn valve may partially reflect a shock wave and partially transform the shock wave energy to vibrations, for example, if these walls are made of metal. The said walls may also partially reflect a shock wave and partially absorb the energy transforming it to heat, for example, is these walls are made of concrete. If the said walls are made of metal and are lined with a sound absorbing material with thermal isolation properties, the said walls also partially reflect a shock wave and partially transform a shock wave to vibrations, while partially absorbing a shock wave.

When a shock wave impacts the walls of shock wave dampers, a shock wave is partially reflected and partially transfers the energy to a wall, causing vibration of the walls of shock wave dampers with intrinsic resonant frequencies. Periodically, the next impacts of a shock wave increase the vibration amplitude of the walls of shock wave dampers to high values. Thus, the walls of a return valve and the walls of shock wave dampers installed on a nonreturn valve vibrate with high amplitudes and high vibration acceleration. In order to prevent the spread of these vibrations, according to the current invention, the air nonreturn valve 173 with shock wave dampers installed on it is connected to chamber 188 for a heat-exchange agent 189 using a vibration isolator 190, while the combustion gas nonreturn valve 191 placed in the guard chamber 192 is connected to the device for removing heat as chamber 188 for a heat-exchange agent 189 using the vibration isolator 193. With a high vibration isolation coefficient, the design of the nonreturn valve 173 with shock wave dampers installed may require additional measures for fixation in a required spatial position, such as installation of additional elastic elements 194 and 195 connecting the housing of the nonreturn valve 173 with the walls of the guard chamber 171 (FIG. 21). Location of the purge fan 196 inside the guard chamber 172 of the air nonreturn valve 173 decreases the level of the shock wave spreading into the air supply channel.

Figure 22:
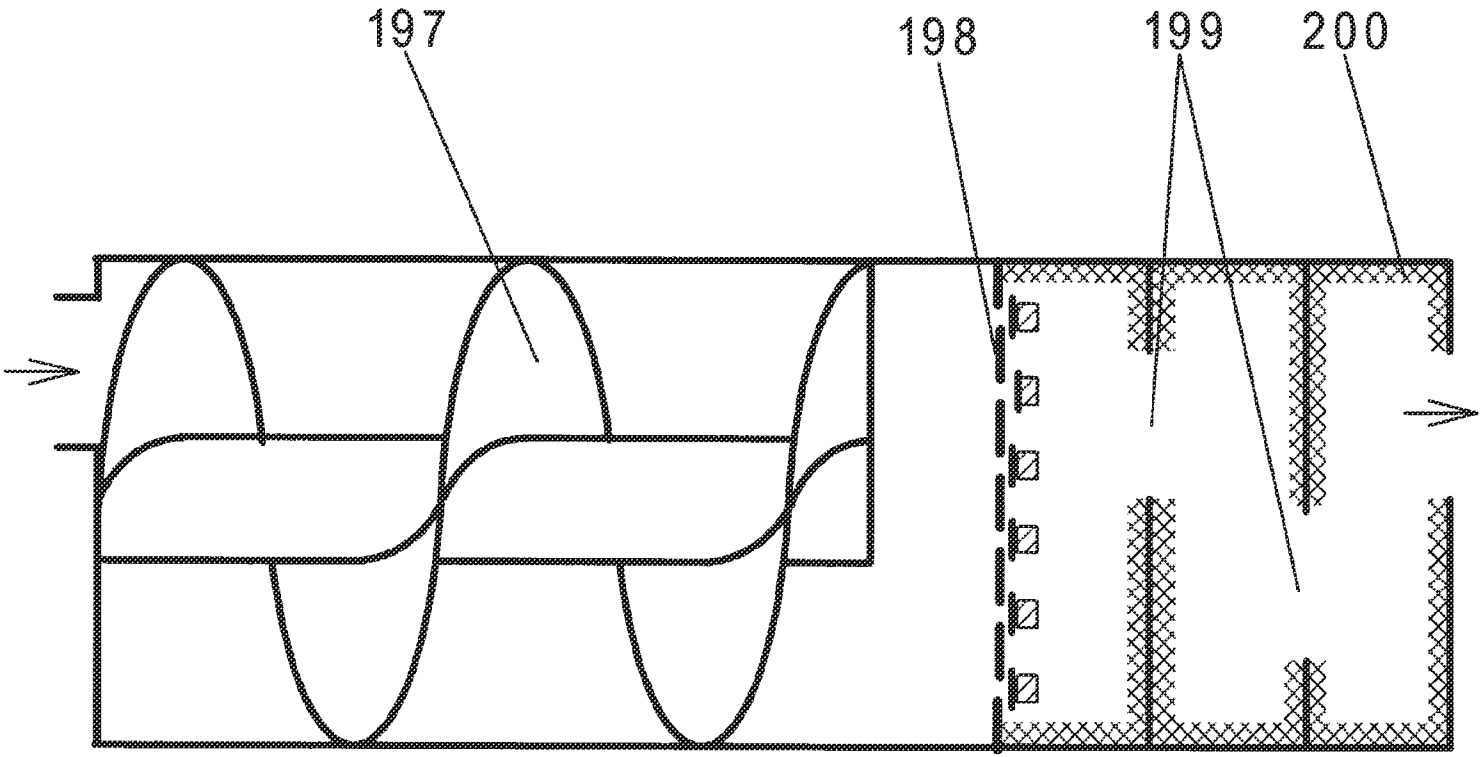
FIG. 22 shows a shock wave damper as a screw-shaped gas flow channel and shock wave damper walls covered with a sound absorbing material.

A shock wave damper may be executed as a screw-shaped channel for gas flow. In FIG. 22, damper 197 executed as a screw-shaped channel is located at the nonreturn valve 198 inlet. At the nonreturn valve 198 outlet, dampers 199 are located executed as a low pass filter with walls lined with a sound absorbing material 200.

Figure 23:
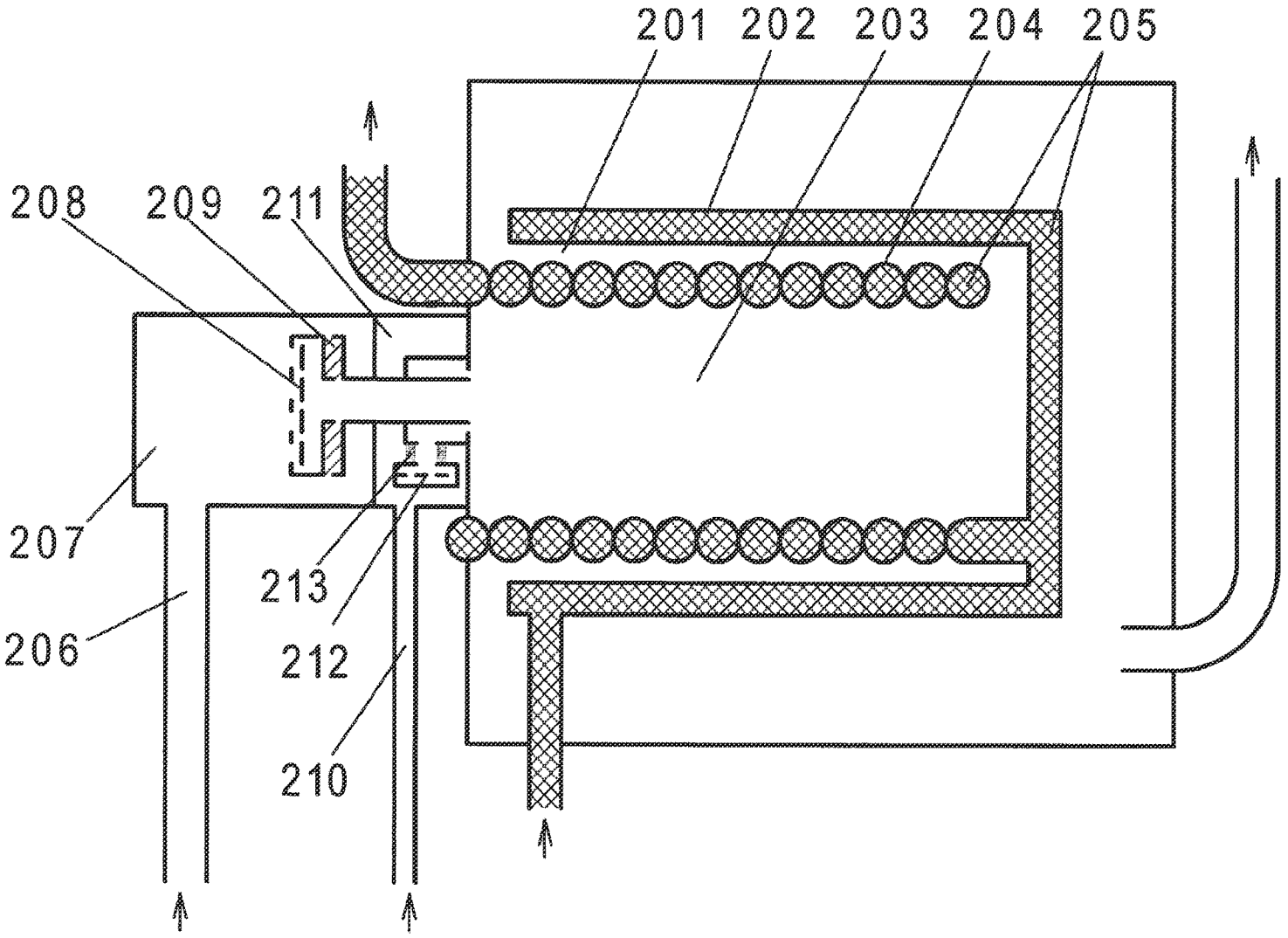
FIG. 23 shows a pulse combustion apparatus with a resonant channel executed as a pass and a device for removing heat executed as a pipe, with a vibration isolation of air and combustion gas nonreturn valves.

In FIG. 23 the resonant channel is executed as gap 201 between the cylinder 202 and the combustion chamber 203 located in it and formed by a spiral-shaped tube 204 with a heat-exchange agent 205. Tube 204 and cylinder 202 jacket form a device for removing heat. The air via tube 206 is supplied to the guard chamber 207 of the air nonreturn valve 208 installed using the vibration isolator 209, and, via the air nonreturn valve 208 is supplied to the combustion chamber 203. The combustion gas via tube 210 is supplied to the guard chamber 211 of the combustion gas nonreturn valve 212 installed using the vibration isolator 213, and, via the combustion gas nonreturn valve 212 is supplied to the combustion chamber 203.

Figure 24:
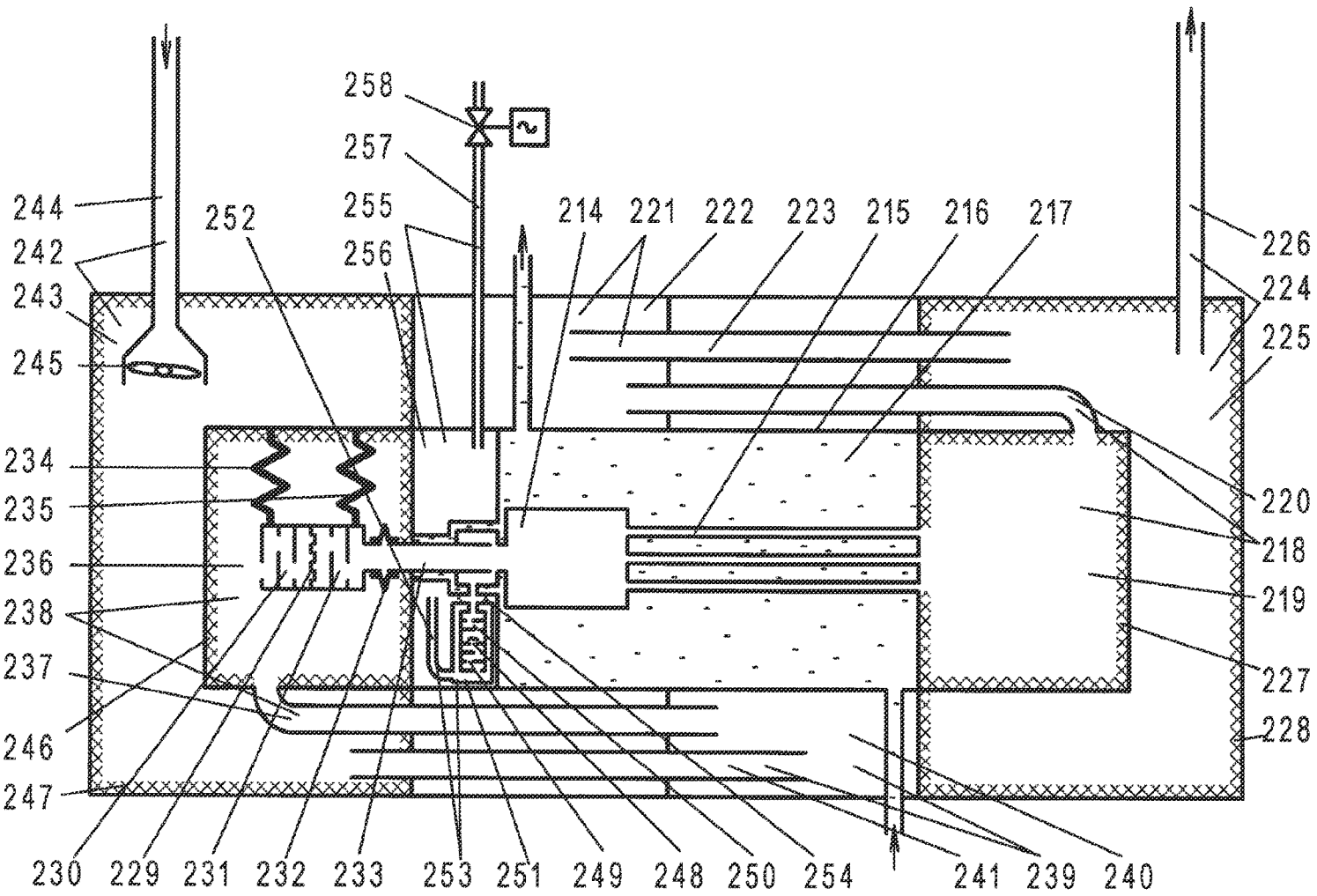
FIG. 24 shows a preferable form of embodiment of a pulse combustion apparatus.

In FIG. 24, a preferrable form of embodiment of a pulse combustion apparatus is show. The combustion chamber 214 and resonant channel 215 executed as several tubes are located in the device for removing heat as chamber 216 with a heat-exchange agent 217. After resonant channel 215, Helmholtz resonator 218, comprising the chamber 219 and induction channel as tube 220, Helmholtz resonator 221 comprising the chamber 222 and induction channel as tube 223, Helmholtz resonator 224 comprising the chamber 225 and induction channel as tube 226 are installed sequentially. Helmholtz resonators 218, 221 and 224 have an intrinsic resonant frequency below the pulse combustion frequency. Chamber 219 is located inside chamber 225. The walls of chambers 219 and 225 are lined with a sound absorbing material 227 and 228 with heat isolation properties.

At the air nonreturn valve 229 outlet, shock wave dampers 230 are installed, while at the air nonreturn valve 229 inlet, shock wave dampers 231 are installed. The air nonreturn valve 229 with dampers 230 and 231 installed on it, is connected via the vibration isolator 232 to the tube 233 washed by a heat-exchange agent 217 and fixed in place with elastic elements 234 and 235. The guard chamber 236 and tube 237 form the Helmholtz resonator 238. Sequentially with the Helmholtz resonator 238, Helmholtz resonator 239 comprising the chamber 240 and the tube 241 and Helmholtz resonator 242 comprising the chamber 243 and the tube 244 are installed. Inside the chamber 243, the chamber 236 and the purge fan 245 are located. The walls of chambers 236 and 243 are lined with a sound absorbing material 246 and 247 with heat isolation properties. Helmholtz resonators 236, 239 and 242 have an intrinsic resonant frequency below the pulse combustion frequency.

At the combustion gas nonreturn valve 248 inlet, shock wave dampers 249 are installed, while at the combustion gas nonreturn valve 248 outlet, shock wave dampers 250 are installed. The combustion gas nonreturn valve 248 with shock wave dampers 249 and 250 is located in the guard chamber 251, which together with tube 252 forms the Helmholtz resonator 253. Helmholtz resonator 253 is installed using the vibration isolator 254. Sequentially with the Helmholtz resonator 253, Helmholtz resonator 255 comprising the chamber 256 and the tube 257 is installed. Helmholtz resonator 253 is located inside the chamber 256 of the Helmholtz resonator 255. Helmholtz resonators 253 and 255 have an intrinsic resonant frequency below the pulse combustion frequency. The combustion gas supply regulator 258 is installed on the tube 257.

In a preferrable form of embodiment of a pulse combustion apparatus shown in FIG. 25, installation of tube 252 is optional, the chamber 219 may be located inside the chamber of the Helmholtz resonator of the air channel, the chamber 236 may be located inside the chamber of the exhaust Helmholtz resonator, several parallel nonreturn valves 248 may be used with shock wave dampers installed at inlet and outlet and located in a single guard chamber or each in an individual guard chamber. Chambers 222 and 240 walls may be lined with a sound absorbing material with thermal isolation properties. The pipes of air Helmholtz resonators may be located inside the pipes of exhaust Helmholtz resonators pipes and/or exhaust Helmholtz resonators pipes may be located inside air Helmholtz resonators pipes.

The invention claimed is:

1. A pulse combustion apparatus, comprising:

a combustion chamber, at least one resonant channel connected to the combustion chamber, a device configured to remove heat, which is linked to the combustion chamber and to the at least one resonant channel, comprising at least one chamber and/or at least one tube, configured to accommodate a heat-exchanging agent, and a device configured to supply air and combustion gas, connected to the combustion chamber, comprising at least one gaseous medium nonreturn valve and at least one guard chamber of the at least one nonreturn valve, wherein the at least one gaseous medium nonreturn valve is directly or indirectly linked to the device configured to remove heat via a vibration isolator, the vibration isolator being configured to compensate for vibrations of which at least one gaseous medium nonreturn valve is the source, and wherein at least one shock wave damper rigidly connected to a corresponding nonreturn valve is installed along the gaseous media flow on at least one gaseous media nonreturn valve inlet and/or outlet.

2. The apparatus according to claim 1, wherein the at least one resonant channel comprises at least one resonant tube.

3. The apparatus according to claim 1, wherein the combustion chamber is located in a tube, a gap being provided between the tube and the combustion chamber in the at least one resonant channel.

4. The apparatus according to claim 1, wherein at least one guard chamber wall is lined with a material with sound absorbing properties.

5. The apparatus according to claim 1, wherein the at least one gaseous media nonreturn valve comprises at least two gaseous media nonreturn valves, wherein at least one of said valves is an air nonreturn valve and at least one of said valves is a combustion gas nonreturn valve, the apparatus further comprising at least two guard chambers, respectively, for the air nonreturn valve and the combustion gas nonreturn valve.

6. The apparatus according to claim 1, wherein the at least one gaseous media nonreturn valve is a combustion mixture nonreturn valve.

7. The apparatus according to claim 1, wherein the at least one gaseous media nonreturn valve is a mechanical nonreturn valve.

8. The apparatus according to claim 1, wherein the at least one gaseous media nonreturn valve is directly linked to the device configured to remove heat via the vibration isolator.

9. The apparatus according to claim 1, wherein the vibration isolator is a cylinder-shaped element with at least one transverse corrugation.

10. The apparatus according to claim 1, wherein the vibration isolator is a cylinder-shaped element made of elastic material.

11. The apparatus according to claim 1, wherein the vibration isolator is a flat circular membrane with one or more circular corrugations.

12. The apparatus according to claim 1, wherein the at least one gaseous media nonreturn valve and at least one damper have the same housing.

13. The apparatus according to claim 1, wherein the at least one gaseous media nonreturn valve with a rigidly connected shock wave damper are fixed in a required spatial position using elastic elements.

14. The apparatus according to claim 1, wherein the vibrations are caused by a gas flow rate change in the at least one gaseous media nonreturn valve.

15. The apparatus according to claim 1, wherein the vibrations are caused by sudden deceleration of gas flow after openings of the at least one gaseous media nonreturn valve are blocked by membranes.

16. The apparatus according to claim 1, wherein the vibration isolator is designed to compensate for vibrations caused by recurring shock waves that result from sudden deceleration of gas flow after openings of the at least one gaseous media nonreturn valve are blocked by membranes.

17. The The apparatus according to claim 1, wherein the vibration isolator is designed to preferentially compensate for vibrations arising from the at least one gaseous medium nonreturn valve, rather than other vibrations caused by explosive combustion in the combustion chamber.

18. A pulse combustion apparatus, comprising:

a combustion chamber, at least one resonant channel connected to the combustion chamber, a device configured to remove heat, which is linked to the combustion chamber and to the at least one resonant channel, comprising at least one chamber and/or at least one tube, configured to accommodate a heat-exchanging agent, and a device configured to supply air and combustion gas, connected to the combustion chamber, comprising at least one gaseous medium nonreturn valve and at least one guard chamber of the at least one nonreturn valve, wherein the at least one gaseous medium nonreturn valve is directly or indirectly linked to the device configured to remove heat via a vibration isolator, the vibration isolator being configured to compensate for vibrations of which at least one gaseous medium nonreturn valve is the source, and wherein the at least one gaseous media nonreturn valve comprises first and second gaseous media nonreturn valves, wherein the first gaseous media nonreturn valve is connected to the device configured to remove heat indirectly via the combustion chamber using a first vibration isolator, and wherein the second gaseous media nonreturn valve is linked to the combustion chamber using a pipe with coaxial connecting pipes located between a tube and a second vibration isolator and interconnected forming a maze with an inlet hole formed in the said pipe.

* * * * *